US010665922B2

(12) United States Patent
Takahashi et al.

(10) Patent No.: US 10,665,922 B2
(45) Date of Patent: May 26, 2020

(54) ANTENNA DEVICE AND ELECTRONIC APPARATUS

(71) Applicant: Murata Manufacturing Co., Ltd., Nagaokakyo-shi, Kyoto-fu (JP)

(72) Inventors: Hironobu Takahashi, Nagaokakyo (JP); Hideaki Kobayashi, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 149 days.

(21) Appl. No.: 16/006,881

(22) Filed: Jun. 13, 2018

(65) Prior Publication Data

US 2018/0294544 A1 Oct. 11, 2018

Related U.S. Application Data

(63) Continuation of application No. PCT/JP2017/000957, filed on Jan. 13, 2017.

(30) Foreign Application Priority Data

Jan. 18, 2016 (JP) ..... 2016-006761
Mar. 17, 2016 (JP) ..... 2016-054563

(51) Int. Cl.
*H01Q 1/38* (2006.01)
*H01Q 1/22* (2006.01)
(Continued)

(52) U.S. Cl.
CPC ..... *H01Q 1/2225* (2013.01); *H01Q 1/2208* (2013.01); *H01Q 1/243* (2013.01);
(Continued)

(58) Field of Classification Search
CPC .... H01G 1/2225; H01G 1/2208; H01G 1/243; H01G 1/38; H01G 1/528; H01G 7/00
See application file for complete search history.

(56) References Cited

U.S. PATENT DOCUMENTS

2012/0091821 A1 4/2012 Kato et al.
2015/0244064 A1* 8/2015 Murayama ..... G06K 7/10336 343/702

FOREIGN PATENT DOCUMENTS

JP 2009-038722 A 2/2009
JP 2014-123858 A 7/2014
(Continued)

OTHER PUBLICATIONS

Official Communication issued in International Patent Application No. PCT/JP2017/000957, dated Apr. 4, 2017.

*Primary Examiner* — Graham P Smith
(74) *Attorney, Agent, or Firm* — Keating & Bennett, LLP

(57) ABSTRACT

An antenna device includes a coil antenna including a coil conductor wound around a coil opening, and a planar conductor including a surface facing a portion of the coil opening and a portion of an area including the coil conductor. A minimum separation distance between the coil opening and the planar conductor in a direction perpendicular or substantially perpendicular to the planar conductor is larger than a minimum separation distance between the coil conductor and the planar conductor in the same direction. The planar conductor includes a first region that overlaps the coil opening and a third region that overlaps an outer edge of the coil conductor in plan view of the coil opening, and the first region includes a recessed portion that is recessed in a direction away from the coil conductor.

20 Claims, 25 Drawing Sheets

(51) Int. Cl.
*H01Q 1/24* (2006.01)
*H01Q 1/52* (2006.01)
*H01Q 7/00* (2006.01)

(52) U.S. Cl.
CPC ..... *H01Q 1/38* (2013.01); *H01Q 1/528* (2013.01); *H01Q 7/00* (2013.01)

(56) References Cited

FOREIGN PATENT DOCUMENTS

| | | | |
|---|---|---|---|
| JP | 2015-149678 | A | 8/2015 |
| WO | 2010/122685 | A1 | 10/2010 |

* cited by examiner

ANTENNA DEVICE AND ELECTRONIC APPARATUS

CROSS REFERENCE TO RELATED APPLICATIONS

This application claims the benefit of priority to Japanese Patent Application No. 2016-054563 filed on Mar. 17, 2016 and Japanese Patent Application No. 2016-006761 filed on Jan. 18, 2016 and is a Continuation Application of PCT Application No. PCT/JP2017/000957 filed on Jan. 13, 2017. The entire contents of these applications are hereby incorporated herein by reference.

BACKGROUND OF THE INVENTION

1. Field of the Invention

The present invention relates to an antenna device including a coil antenna, and, in particular, to an antenna device that includes a planar conductor and to an electronic apparatus including the antenna device.

2. Description of the Related Art

An antenna device that efficiently emits magnetic flux by coupling a coil antenna with a planar conductor is disclosed in International Publication No. 2010/122685. In this way, when the antenna device using the coil antenna is provided in an electronic apparatus that is provided with the planar conductor, the antenna device is able to be easily installed in the electronic apparatus by providing the planar conductor so as not to intercept the magnetic flux of the coil antenna.

When the antenna device disclosed in International Publication No. 2010/122685 is used in an electronic apparatus including, for example, a metallic casing, the coil antenna comes into close contact with the metallic casing. Therefore, the magnetic flux generated from the coil antenna links with the metallic casing, and, thus, causes a strong eddy current to flow in the metallic casing, and an increase in loss and a reduction in a Q value of the antenna device to occur.

In general, a factor of power transmission efficiency in a near field is a product of a coupling coefficient k between a transmission coil antenna and a reception coil antenna and a Q value of the transmission coil antenna and the reception coil antenna (the product kQ). Therefore, a reduction in the Q value causes a reduction in the power transmission efficiency.

SUMMARY OF THE INVENTION

Preferred embodiments of the present invention provide antenna devices in which deterioration in characteristics caused by an eddy current that flows in a planar conductor of, for example, a metallic casing is reduced or prevented, and electronic apparatuses including the antenna devices.

The inventors of preferred embodiments of the present invention have discovered that it is difficult to obtain a coil antenna having a high Q value, whereas a coupling coefficient between a planar conductor and a coil antenna is able to be made sufficiently large, so that increasing the Q value of the coil antenna and the planar conductor is effective in increasing the product kQ.

An antenna device according to a preferred embodiment of the present invention includes a coil antenna that includes a coil conductor wound around a coil opening, and a planar conductor that includes a surface facing a portion of the coil opening and a portion of an area in which the coil conductor is provided. A minimum separation distance between the coil opening and the planar conductor in a direction perpendicular or substantially perpendicular to the planar conductor is larger than a minimum separation distance between the coil conductor and the planar conductor in the direction perpendicular or substantially perpendicular to the planar conductor.

With above-described structure, a space is provided between the coil conductor and the planar conductor, so that the amount of magnetic flux that crosses the planar conductor is reduced, and the Q value of the coil antenna is improved.

In an antenna device according to a preferred embodiment of the present invention, it is preferable that the planar conductor includes a first region that overlaps at least a portion of the coil opening and a third region that overlaps an outer edge of the coil conductor in plan view of the coil opening, and, compared to the third region, the first region is provided with a recessed portion that is recessed in a direction away from the coil conductor.

With the above-described structure, although a coil antenna including a coil conductor having a simple winding pattern is used, a space is provided between the coil conductor and the planar conductor, so that the amount of magnetic flux that crosses the planar conductor is reduced, and the Q value of the coil antenna is improved.

In an antenna device according to a preferred embodiment of the present invention, it is preferable that the first region and the second region are a region extending over an entire or substantially an entire periphery of the coil conductor in a winding direction. This causes the effect of reducing or preventing an eddy current to be effective, so that an antenna device having a higher Q value is obtained.

In an antenna device according to a preferred embodiment of the present invention, a plurality of the recessed portions of the planar conductor are provided. With this structure, compared to a structure in which a recessed portion extends continuously, a reduction in the mechanical strength of the planar conductor is reduced or prevented.

In an antenna device according to a preferred embodiment of the present invention, it is preferable that the coil antenna includes a magnetic body that is disposed on a side opposite to the planar conductor and along the area in which the coil conductor is provided. With this structure, since the magnetic body provides a magnetic path for magnetic flux that passes through the magnetic body, the magnetic flux that crosses the coil antenna is increased. In addition, unwanted coupling between the coil antenna and conductors other than the planar conductor is reduced or prevented.

In an antenna device according to a preferred embodiment of the present invention, it is preferable that the planar conductor includes a cutout portion that extends inwardly from an outer edge, and that the coil opening overlaps at least a portion of the cutout portion in plan view of the coil opening. This causes the coil antenna to overlap the planar conductor in plan view of the planar conductor, so that space is saved.

In an antenna device according to a preferred embodiment of the present invention, it is preferable that the cutout portion includes an inner portion and an outer portion, and the inner portion is wider than the outer edge portion when seen in plan view of the planar conductor. This makes it possible to increase the coupling coefficient between the planar conductor and the coil antenna.

An antenna device according to a preferred embodiment of the present invention includes a coil antenna that includes a first coil conductor portion disposed on an inner peripheral side and wound around a coil opening and a second coil conductor portion disposed on an outer peripheral side; and a planar conductor that includes a surface facing the first coil conductor portion and the second coil conductor portion. A minimum separation distance between the first coil conductor portion and the planar conductor in a direction perpendicular or substantially perpendicular to the planar conductor is larger than a minimum separation distance between the second coil conductor portion and the planar conductor in the direction perpendicular or substantially perpendicular to the planar conductor.

With the above-described structure, a space is provided between the coil conductor and the planar conductor, so that the amount of magnetic flux that crosses the planar conductor is reduced, and the Q value of the coil antenna is improved.

In an antenna device according to a preferred embodiment of the present invention, it is preferable that the planar conductor includes a second region that overlaps an inner edge of the coil conductor and a third region that overlaps an outer edge of the coil conductor in plan view of the coil opening, and, compared to the third region, the second region is provided with a recessed portion that is recessed in a direction away from the coil conductor.

With the above-described structure, although a coil antenna including a coil conductor having a simple winding pattern is provided, a space is provided between the coil conductor and the planar conductor, so that the amount of magnetic flux that crosses the planar conductor is reduced, and the Q value of the coil antenna is improved.

In an antenna device according to a preferred embodiment of the present invention, it is preferable that the second region is a region extending over an entire or substantially an entire periphery of the coil conductor in a winding direction. This causes the effect of reducing or preventing an eddy current to be effective, so that an antenna device having a higher Q value is obtained.

In an antenna device according to a preferred embodiment of the present invention, it is preferable that a plurality of the recessed portions of the planar conductor are provided. With this structure, compared to a structure in which a recessed portion extends continuously, a reduction in the mechanical strength of the planar conductor is reduced or prevented.

In an antenna device according to a preferred embodiment of the present invention, it is preferable that the coil antenna includes a magnetic body that is disposed on a side opposite to the planar conductor and along an area in which the coil conductor is provided. With this configuration, since the magnetic body provides a magnetic path for magnetic flux that passes through the magnetic body, the magnetic flux that crosses the coil antenna is increased. In addition, unwanted coupling between the coil antenna and conductors other than the planar conductor is reduced or prevented.

In an antenna device according to a preferred embodiment of the present invention, it is preferable that the planar conductor includes a cutout portion that extends inwardly from an outer edge, and the coil opening overlaps at least a portion of the cutout portion in plan view of the coil opening. This causes the coil antenna to overlap the planar conductor in plan view of the planar conductor, so that space is saved.

In an antenna device according to a preferred embodiment of the present invention, it is preferable that the cutout portion includes an inner portion and an outer portion, and the inner portion is wider than the outer edge portion when seen in plan view of the planar conductor. This makes it possible to increase the coupling coefficient between the planar conductor and the coil antenna.

An electronic apparatus according to a preferred embodiment of the present invention includes an antenna device including a coil antenna that includes a coil conductor wound around a coil opening; and a planar conductor that includes a surface facing a portion of the coil opening and a portion of an area in which the coil conductor is provided. A minimum separation distance between the coil opening and the planar conductor in a direction perpendicular or substantially perpendicular to the planar conductor is larger than a minimum separation distance between the coil conductor and the planar conductor in the direction perpendicular or substantially perpendicular to the planar conductor.

With the above-described structure, signals or power are transmitted with a high power transmission efficiency between the antenna device and a coupling antenna device.

An electronic apparatus according to a preferred embodiment of the present invention includes an antenna device including a coil antenna that includes a first coil conductor portion disposed on an inner peripheral side and wound around a coil opening and a second coil conductor portion disposed on an outer peripheral side; and a planar conductor that includes a surface facing the first coil conductor portion and the second coil conductor portion. A minimum separation distance between the first coil conductor portion and the planar conductor in a direction perpendicular or substantially perpendicular to the planar conductor is larger than a minimum separation distance between the second coil conductor portion and the planar conductor in the direction perpendicular or substantially perpendicular to the planar conductor.

With the above-described structure, signals or power are transmitted with a high power transmission efficiency between the antenna device and a coupling antenna device.

According to preferred embodiments of the present invention, antenna devices in which deterioration in characteristics caused by an eddy current that flows in a planar conductor is reduced or prevented, and electronic apparatuses including the antenna device are provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
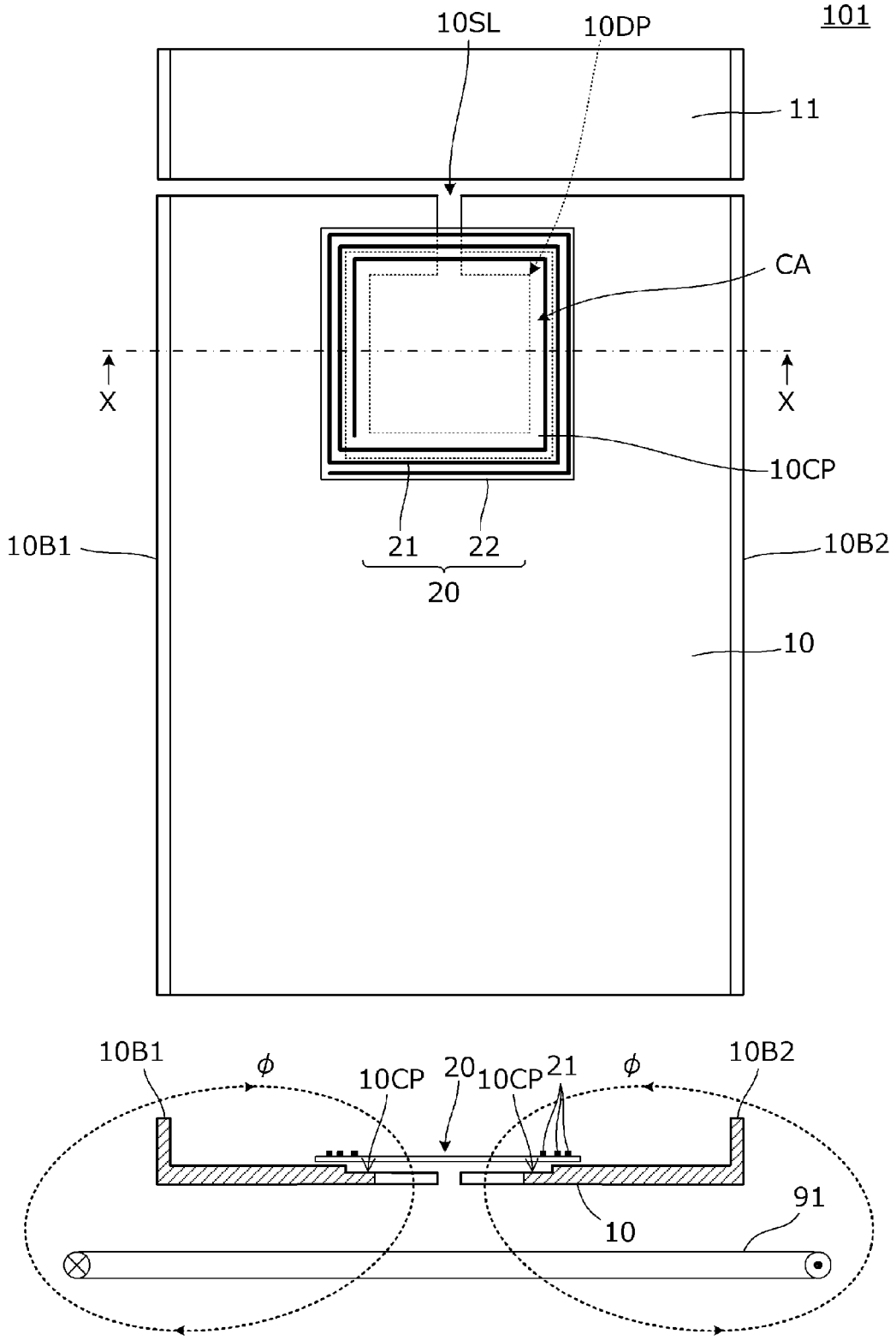
FIG. 1 shows a plan view of an antenna device 101 according to a first preferred embodiment of the present invention, and a sectional view of a portion thereof taken along X-X.

Preferred embodiments of the present invention are described below with reference to the drawings, and corresponding portions are denoted by the same reference numerals in the drawings. Considering the description of the main points or easier understanding, as a matter of convenience, the preferred embodiments of the present invention are described separately. However, structures in different preferred embodiments may be partially replaced or combined. In a second preferred embodiment and subsequent preferred embodiments, matters that are common to those of a first preferred embodiment are not described, and points that differ are only described. In particular, the same advantageous operational effects resulting from the same structures are not successively mentioned for each preferred embodiment.

First Preferred Embodiment

FIG. 1 shows a plan view of an antenna device 101 according to a first preferred embodiment of the present invention, and a sectional view of a portion thereof taken along X-X. The antenna device 101 is provided in, for example, a portable electronic apparatus (hereunder simply referred to as the "electronic apparatus"). The plan view of FIG. 1 is a view that is seen from an inner side of a casing of the electronic apparatus (a plan view of a state in which the inner side of the casing is an upper surface). This also similarly applies to each preferred embodiment that is subsequently described.

The antenna device 101 of the present preferred embodiment is applicable not only to portable electronic apparatuses, such as smartphones and feature phones, but also, for example, to various other electronic apparatuses, such as smart watch wearable terminals, smartglass wearable terminals, and other wearable terminals; notebook PCs; tablet terminals; cameras; game machines; toys; and IC tags, SD cards, SIM cards, IC cards, and other information media. This is also similarly applicable to the antenna devices of the different preferred embodiments that are subsequently described.

The casing of the electronic apparatus includes metal portions 10 and 11. The metal portion 10 includes a surface that extends in a plane. A square extending portion 10DP and a slit 10SL that links the extending portion 10DP and one side are provided in the metal portion 10. An inner edge of the extending portion 10DP is continuous with an outer edge of the metal portion 10. The slit 10SL and the extending portion 10DP define an exemplary cutout portion according to the present preferred embodiment. That is, the cutout portion includes the slit 10SL that extends inwardly from the outer edge of the metal portion 10 and the extending portion 10DP such that the cutout portion includes an inner portion and an outer portion, and the inner portion is preferably wider than the outer edge portion when seen in plan view of the metal portion 10.

The metal portions 10 and 11 are each preferably molded out of a metal plate made of aluminum, magnesium, or alloys of these metals, for example. The metal portion 10 includes bent portions 10B1 and 10B2 on corresponding end portions. The casing of the electronic apparatus is a casing in which these metal portions 10 and 11 are integrally molded with a resin portion. The metal portion 10 is an exemplary "planar conductor". The metal portion 11 is not a necessary structural element of the antenna device 101, but may be used as a radiation element of a different antenna, if necessary.

A coil antenna 21 that includes a square or substantially square spiral coil conductor and that is wound around a coil opening CA is provided on a square or substantially square insulating base 22. The insulating base 22 is preferably a sheet made of, for example, a liquid crystal polymer (LCP) or polyimide resin (PI). The coil conductor is preferably, for example, a Cu foil provided on the insulating base 22. In the coil antenna 21, the Cu foil is formed into the pattern of a coil by, for example, photolithography. The insulating base 22 and the coil antenna 21 define a coil antenna sheet 20.

The coil antenna sheet 20 is disposed on the metal portion 10 such that the coil antenna 21 is disposed along an inner edge of the extending portion 10DP at the metal portion 10. Therefore, the metal portion 10 couples with at least a portion of the coil antenna 21. In this manner, the coil antenna 21 and the metal portion 10 of the casing define the antenna device 101.

FIG. 1 also shows a coupling coil antenna 91. The coil antenna 21 and the coupling coil antenna 91 are subjected to magnetic-field coupling as indicated by magnetic flux Φ.

Figure 2A:
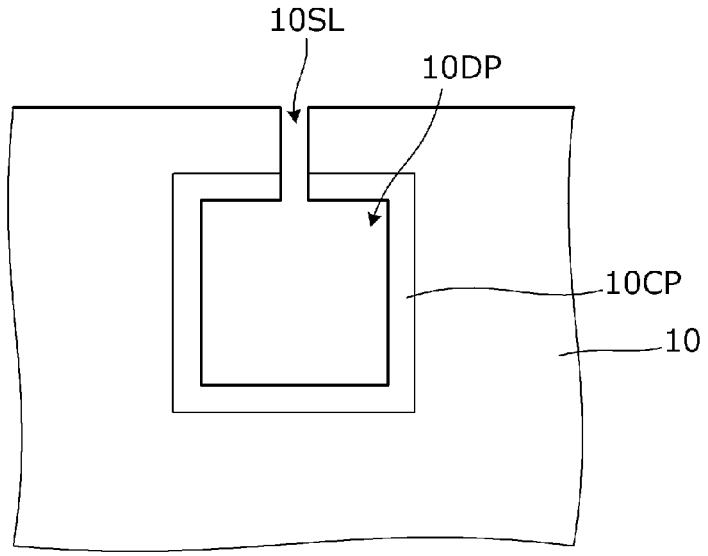
FIG. 2A is a plan view of a metal portion 10 of a casing including a portion that is overlapped by a coil conductor of a coil antenna 21; and a vicinity thereof.
Figure 2B:
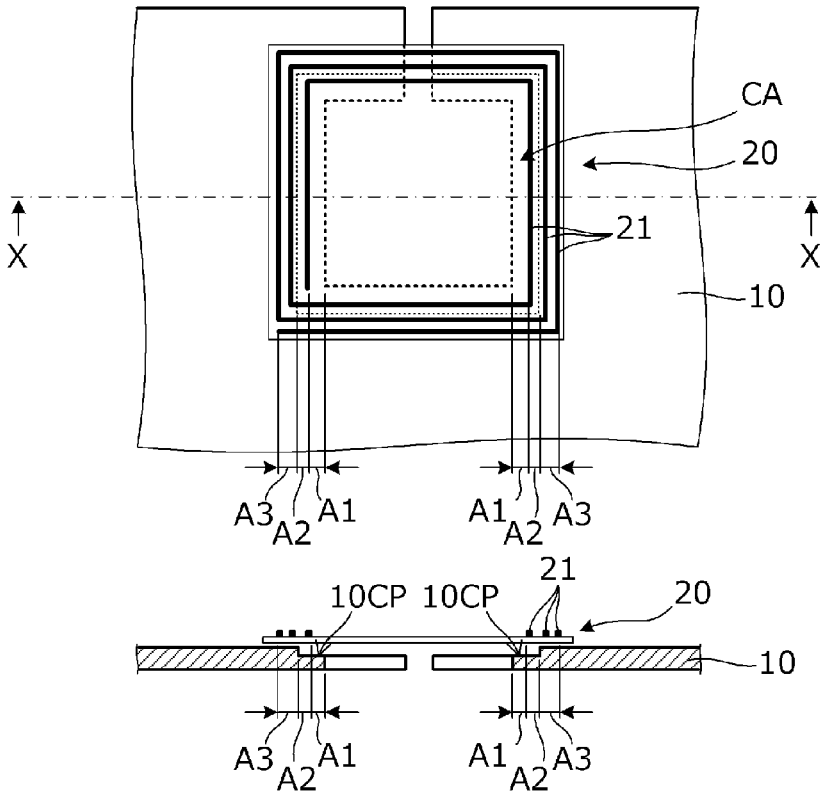
FIG. 2B shows a plan view of a vicinity of a coil antenna sheet 20 with the portion being overlapped by the coil antenna sheet 20, and a sectional view of a portion thereof taken along X-X.

FIG. 2A is a plan view of the metal portion 10 of the casing including a portion that is overlapped by the coil conductor of the coil antenna 21, and a vicinity thereof. FIG. 2B shows a plan view of a state in which this portion is overlapped by the coil antenna sheet 20, and a sectional view of a portion thereof taken along X-X.

The metal portion 10 of the casing includes a surface facing a portion of the coil opening CA and a portion of an area in which the coil conductor is provided. The metal portion 10 includes a first region A1 that overlaps the coil opening CA, a second region A2 that extends to an inner edge of the coil antenna 21, and a third region A3 that overlaps an outer edge of the coil antenna 21 in plan view of the coil opening CA. Compared to the third region A3, the first region A1 and the second region A2 is a recessed portion 10CP that is recessed in a direction away from the coil antenna 21. Therefore, a minimum separation distance between the first region A1 of the metal portion 10 and the coil opening CA in a direction perpendicular or substantially perpendicular to the metal portion 10 (planar conductor) of the casing, or a minimum separation distance between the second region A2 of the metal portion 10 and the coil conductor of the coil antenna 21 in the direction perpendicular or substantially perpendicular to the metal portion 10 is larger than a minimum separation distance between the third region A3 of the metal portion 10 and the coil conductor of the coil antenna 21.

In the coil antenna 21, an inner periphery of a winding area of the coil conductor has a high magnetic flux density. The first region A1 and the second region A2 provide a high magnetic flux density. Therefore, by providing the recessed portion 10CP in the first region A1 and the second region A2, an eddy current that flows in the metal portion 10 is reduced, and the Q value of the coil antenna is improved.

By providing a space defined by the recessed portion 10CP between the coil conductor of the coil antenna 21 and the metal portion 10 (planar conductor) of the casing, the coupling coefficient between the coil antenna 21 and the metal portion 10 tends to decrease. However, the coupling coefficient between the coil antenna 21 and the metal portion 10 is inherently large. Therefore, compared to a reduction in a coupling coefficient k caused by such a space defined by the recessed portion 10CP, an increase in the Q value of the coil antenna 21 and the metal portion 10 dominates, which is effective to increase the product kQ.

Figure 3:
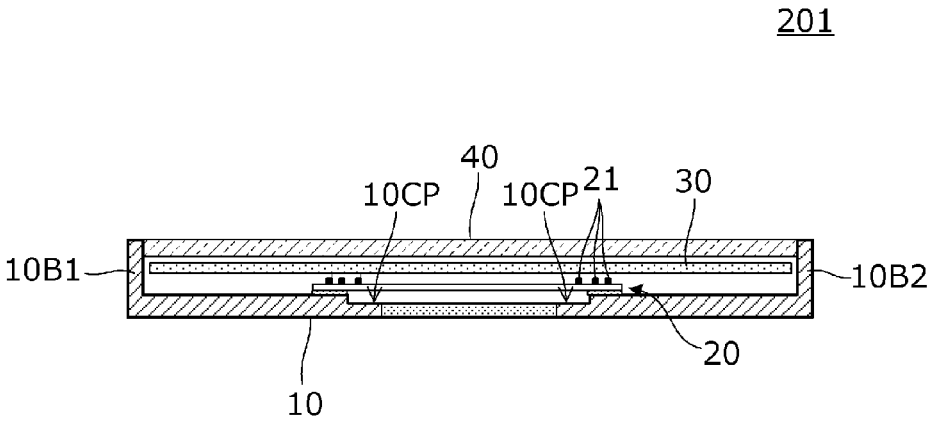
FIG. 3 is a vertical sectional view of an electronic apparatus 201 in a plane that extends through a coil opening of the coil antenna.

FIG. 3 is a vertical sectional view of an electronic apparatus 201 in a plane that extends through the coil opening of the coil antenna. A front unit 40 is provided with, for example, a display panel with a touch panel. Electronic components are installed in the casing of the electronic apparatus 201, and a circuit board 30 at which a conductor pattern is provided is accommodated in the casing of the electronic apparatus 201. The coil antenna sheet 20 is attached to an inner surface of the metal portion 10 with a double-sided adhesive sheet. The coil antenna 21 is electrically coupled with a circuit on the circuit board 30 via a spring pin. The electromagnetically separating recessed portion 10CP may be provided between the coil antenna sheet 20 and the metal portion 10 of the casing, or the entire space may be filled with an insulating material, such as a resin material, and the insulating material may be a dielectric.

Figure 4:
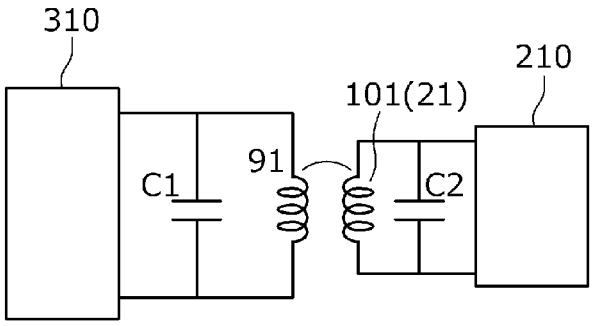
FIG. 4 is a circuit diagram of the antenna device 101 and a coupling antenna device with which the antenna device 101 is coupled.

FIG. 4 is a circuit diagram of the antenna device 101 and a coupling antenna device with which the antenna device 101 is coupled. A capacitor C2 is connected in parallel to the coil antenna 21 of the antenna device 101, and this parallel circuit is connected to an antenna connection circuit 210. The coil antenna 21 and the capacitor C1 define a parallel resonant circuit, and a resonant frequency thereof matches or approximately matches to a frequency band in use. A capacitor C1 is connected in parallel to the coil antenna 91 of the coupling antenna device, and this parallel circuit is connected to an antenna connection circuit 310. The coil antenna 91 and the capacitor C1 define a parallel resonant circuit, and a resonant frequency thereof matches or approximately matches to a frequency band in use. Although the capacitor C2 that is connected to the coil antenna 21 and the capacitor C1 that is connected to the coil antenna 91 may be connected in parallel or in series, it is preferable that the resonant frequency of the parallel resonant circuit or the resonant frequency of the series resonant circuit match or approximately match to the frequency band in use.

For example, when the circuits shown in FIG. 4 are used in NFC (Near Field Communication), the antenna connection circuits 210 and 310 are each a communication circuit. The frequency band used in NFC is preferably, for example, an HF band, which is, for example, about 13.56 MHz. When the circuits are used for WPT (Wireless Power Transmission), the antenna connection circuit 210 is preferably, for example, a power receiving circuit, and the antenna connection circuit 310 is preferably a power transmitting circuit. The frequency band use in WPT is preferably, for example, an HF band, which is, for example, about 6.78 MHz. The antenna device 101 is applicable to any WPT that uses a magnetic-field coupling method, such as an electromagnetic induction method, a magnetic resonance method, or a direct-current resonance method, for example. The size of the coil antenna 21 of the antenna device 101 is sufficiently smaller than a wavelength $\lambda$ at the frequency that is used, and, in the frequency band in use, the radiation characteristics of electromagnetic waves are poor. The size of the coil antenna 21 of the antenna device 101 is preferably less than or equal to about $\lambda/10$, for example. Here, the term "wavelength" refers to an effective wavelength that considers a wavelength shortening effect caused by the dielectricity or the magnetic permeability of the base in which the antenna is provided. Each end of the coil conductor of the coil antenna 21 is preferably connected to a communication circuit, a power receiving circuit, or a power transmitting circuit, for example, at which the frequency band in use is operated.

Second Preferred Embodiment

In a second preferred embodiment of the present invention, an example that differs from the first preferred embodiment in the shape of a cutout portion provided in a metal portion of a casing and in the shape of a coil antenna is described.

Figure 5:
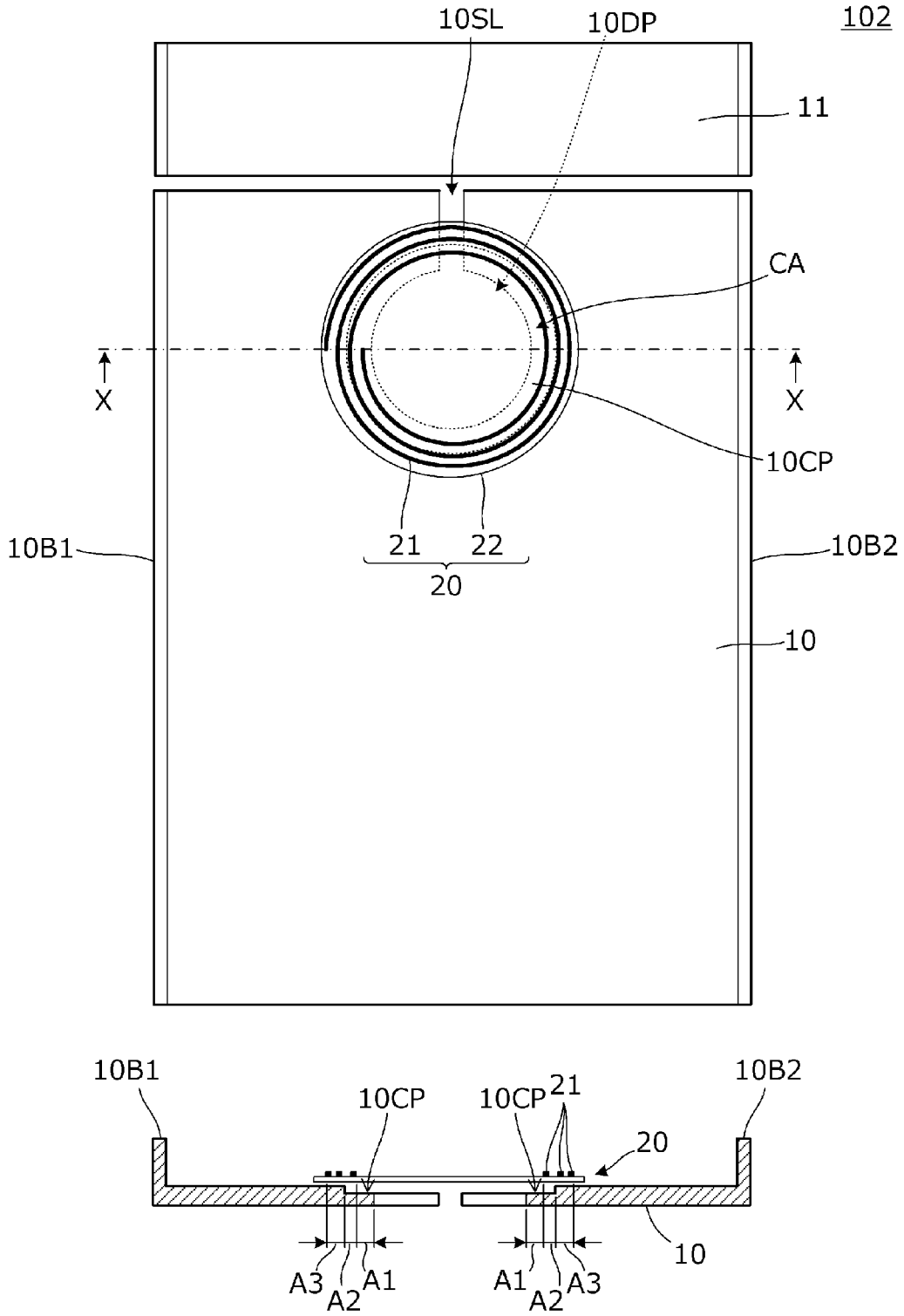
FIG. 5 shows a plan view of an antenna device 102 according to a second preferred embodiment of the present invention, and a sectional view of a portion thereof taken along X-X.
Figure 6A:
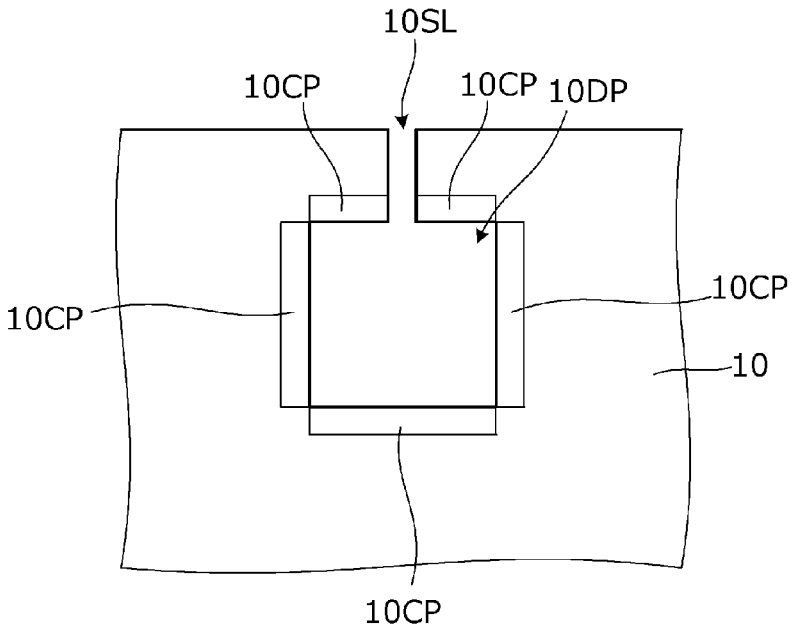
FIG. 6A is a plan view of a metal portion 10 of a casing of an antenna device according to a third preferred embodiment of the present invention including a portion that is overlapped by a coil conductor of a coil antenna 21, and a vicinity thereof.
Figure 6B:
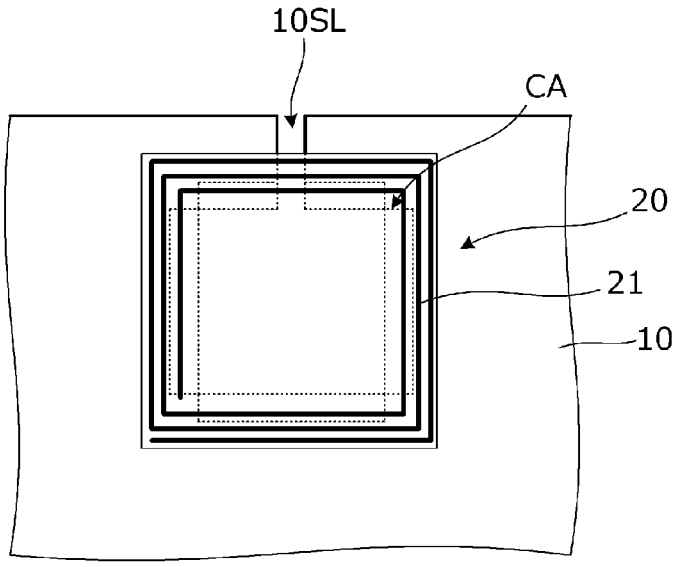
FIG. 6B is a plan view of a vicinity of a coil antenna sheet 20 with the portion being overlapped by the coil antenna sheet 20.
Figure 7A:
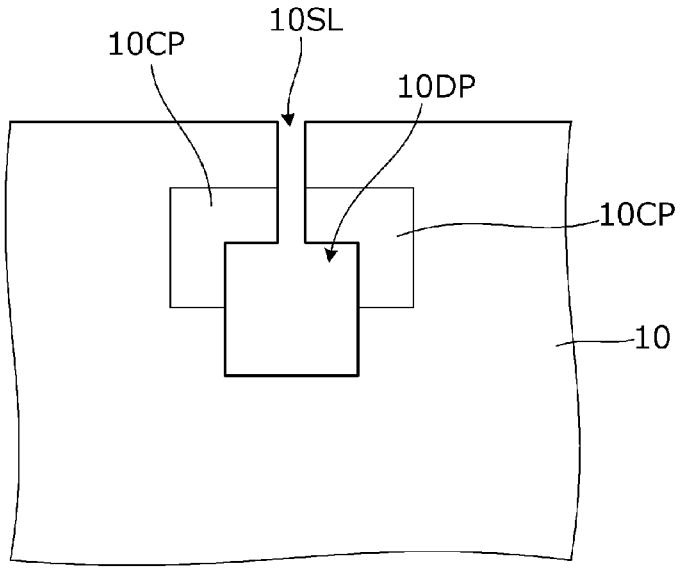
FIG. 7A is a plan view of a metal portion 10 of a casing of a different antenna device according to the third preferred embodiment of the present invention including a portion that is overlapped by a coil conductor of a coil antenna 21, and a of a vicinity thereof.
Figure 7B:
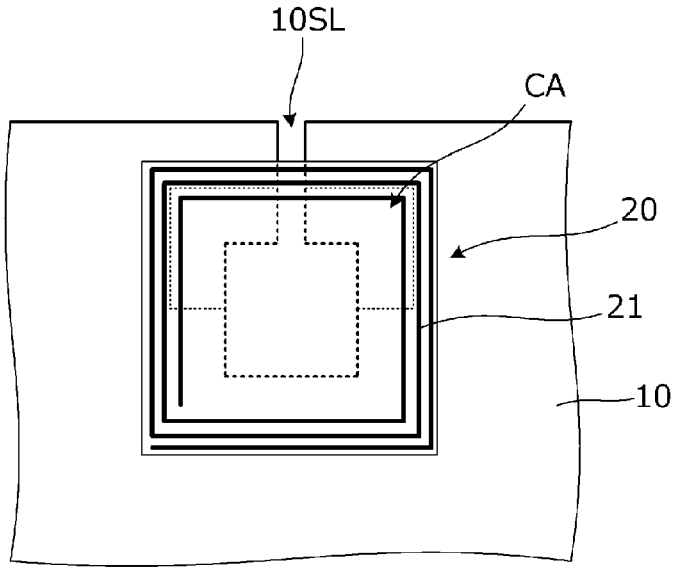
FIG. 7B is a plan view of a vicinity of a coil antenna sheet 20 with the portion being overlapped by the coil antenna sheet 20.
Figure 8A:
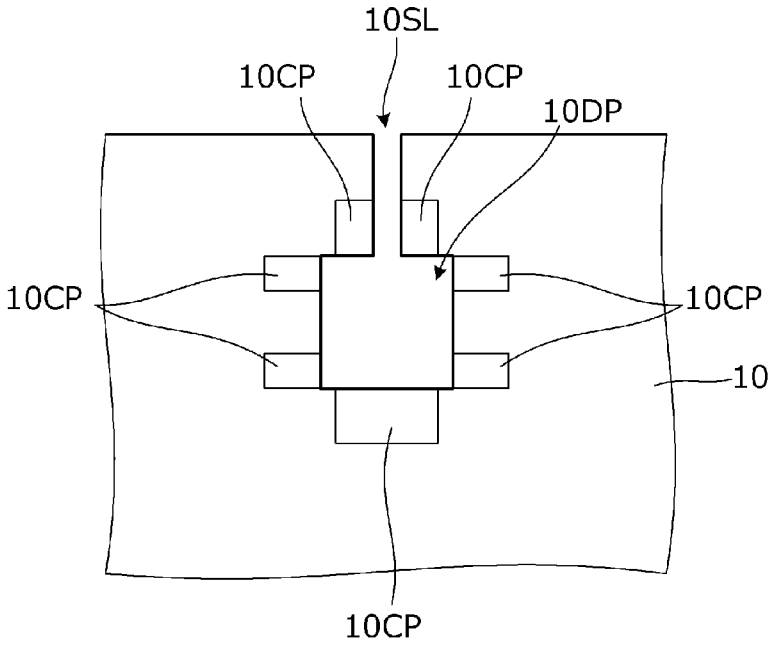
FIG. 8A is a plan view of a metal portion 10 of a casing of a different antenna device according to the third preferred embodiment of the present invention including a portion that is overlapped by a coil conductor of a coil antenna 21, and a vicinity thereof.
Figure 8B:
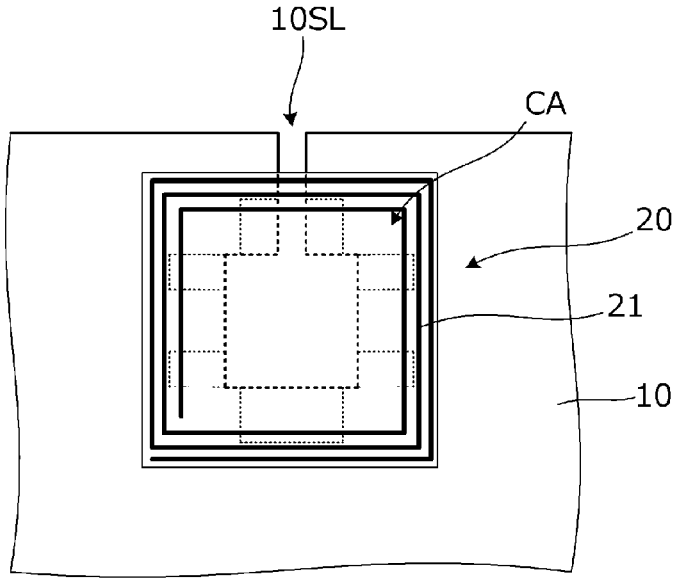
FIG. 8B is a plan view of a vicinity of a coil antenna sheet 20 with the portion being overlapped by the coil antenna sheet 20.
Figure 9A:
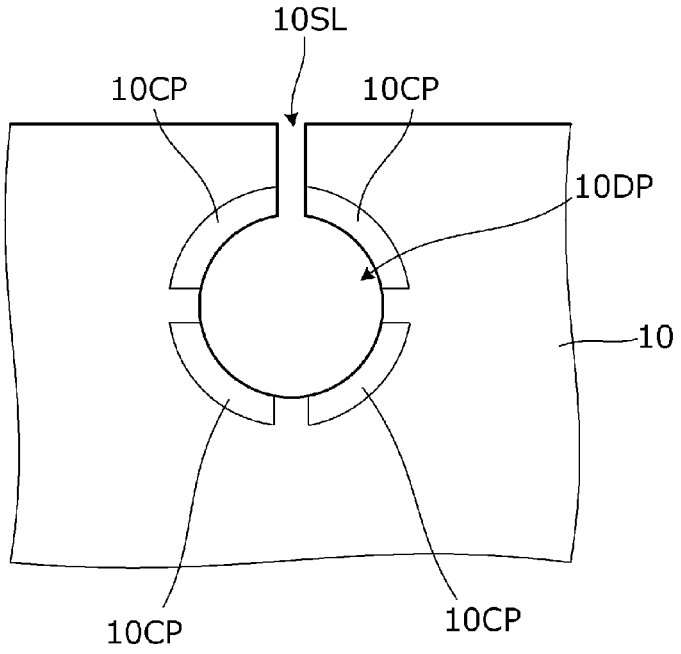
FIG. 9A is a plan view of a metal portion 10 of a casing of a different antenna device according to the third preferred embodiment of the present invention including a portion that is overlapped by a coil conductor of a coil antenna 21, and a vicinity thereof.
Figure 9B:
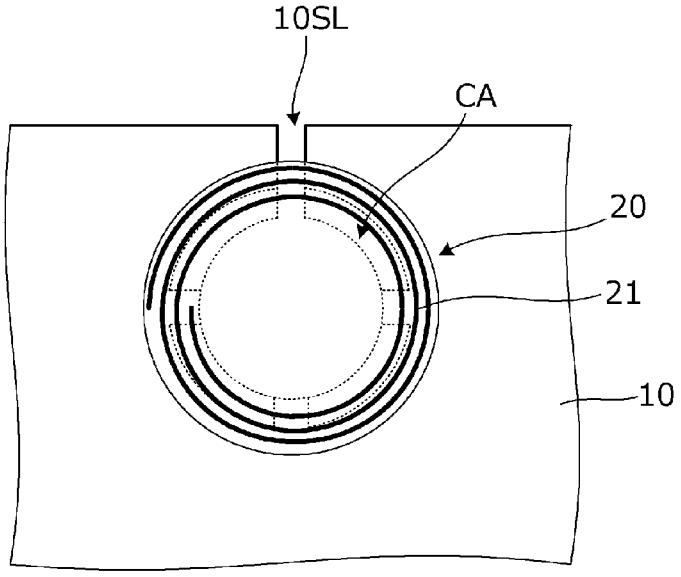
FIG. 9B is a plan view of a vicinity of a coil antenna sheet 20 with the portion being overlapped by the coil antenna sheet 20.
Figure 10A:
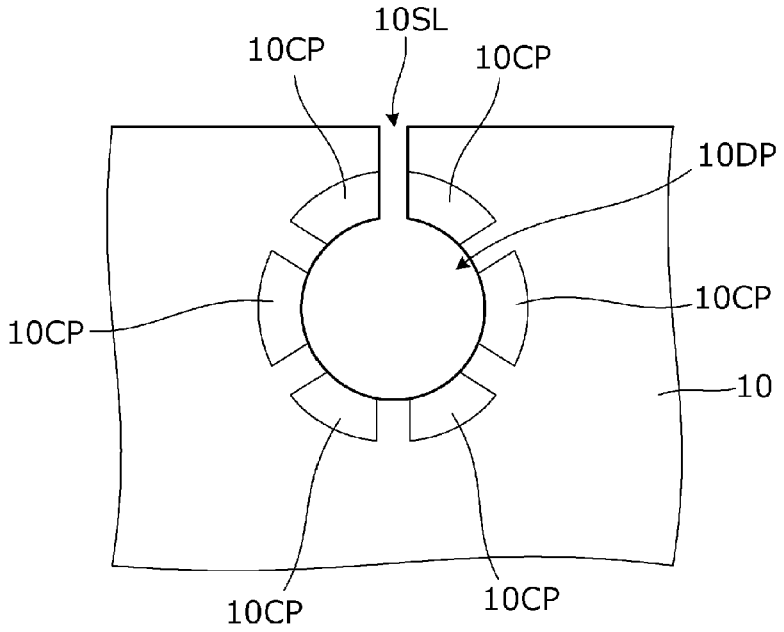
FIG. 10A is a plan view a metal portion 10 of a casing of a different antenna device according to the third preferred embodiment including a portion that is overlapped by a coil conductor of a coil antenna 21, and a vicinity thereof.
Figure 10B:
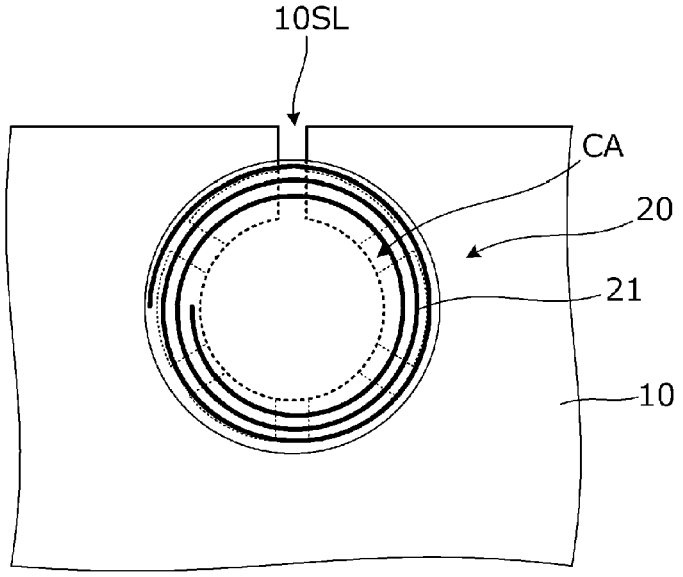
FIG. 10B is a plan view of a vicinity of a coil antenna sheet 20 with the portion being overlapped by the coil antenna sheet 20.
Figure 11A:
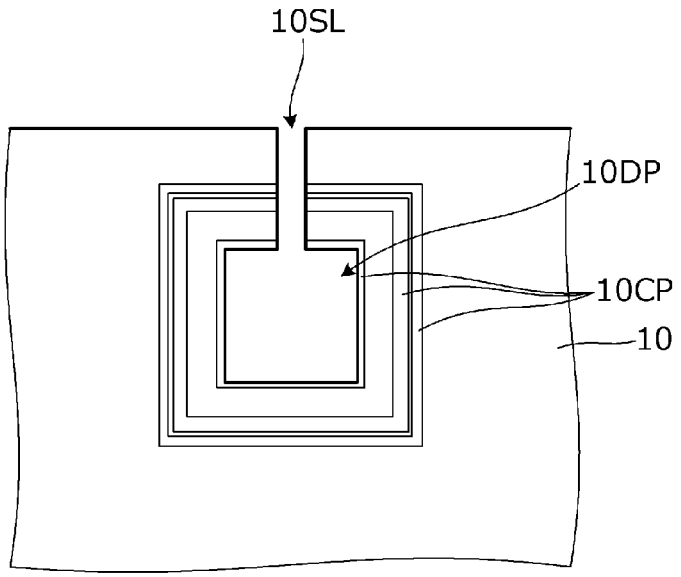
FIG. 11A is a plan view of a metal portion 10 of a casing of a different antenna device according to the third preferred embodiment of the present invention including a portion that is overlapped by a coil conductor of a coil antenna 21, and a vicinity thereof.
Figure 11B:
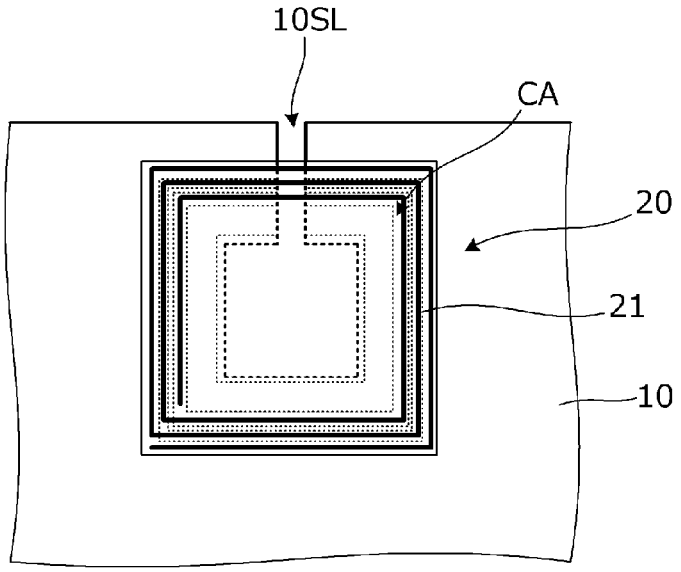
FIG. 11B is a plan view of a vicinity of a coil antenna sheet 20 with the portion being overlapped by the coil antenna sheet 20.
Figure 12A:
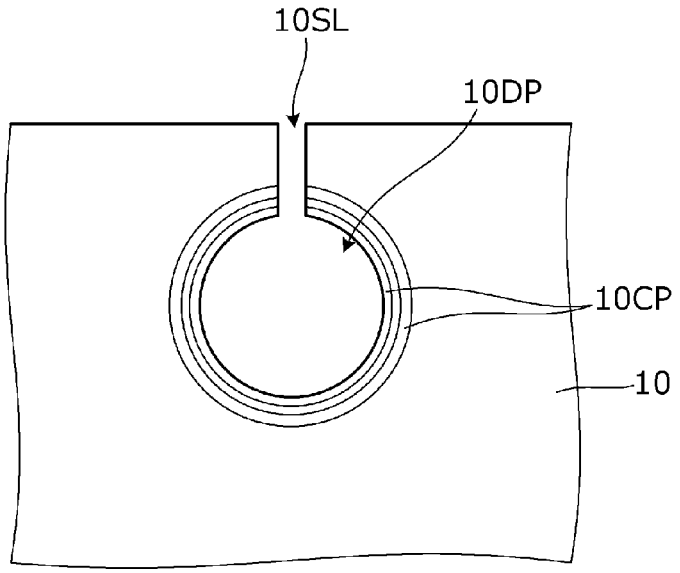
FIG. 12A is a plan view of a metal portion 10 of a casing of a different antenna device according to the third preferred embodiment of the present invention including a portion that is overlapped by a coil conductor of a coil antenna 21, and a vicinity thereof.
Figure 12B:
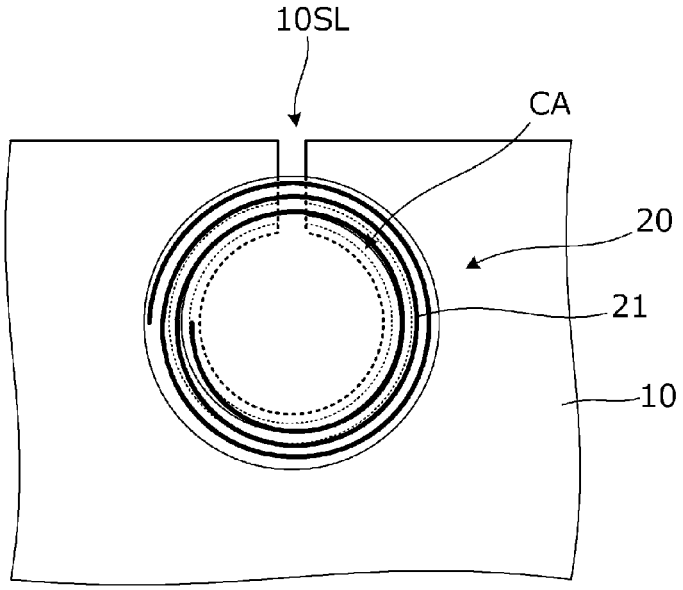
FIG. 12B is a plan view of a vicinity of a coil antenna sheet 20 with the portion being overlapped by the coil antenna sheet 20.

FIG. 5 shows a plan view of an antenna device 102 according to the second preferred embodiment, and a sectional view of a portion thereof taken along X-X. A coil antenna 21 of the antenna device 102 is defined by a spiral coil conductor. In accordance with this structure, a cutout portion that is provided in a metal portion 10 of the casing includes a slit 10SL and a circular or substantially circular extending portion 10DP.

The metal portion 10 of the casing includes a first region A1 that overlaps a coil opening CA, a second region A2 that contacts the first region A1 and that does not extend to an outer edge of an area in which the coil antenna 21 is provided, and a third region A3 that extends to the outer edge from the second region A2 in plan view of the coil opening CA. Compared to the third region A3, the first region A1 and the second region A2 define a recessed portion 10CP that is recessed in a direction away from the coil antenna 21. Therefore, a minimum separation distance between the first region A1 of the metal portion 10 and the coil opening CA in a direction perpendicular or substantially perpendicular to the metal portion 10 (planar conductor) of the casing, or a minimum separation distance between the second region A2 of the metal portion 10 and the coil conductor of the coil antenna 21 in the direction perpendicular or substantially perpendicular to the metal portion 10 is larger than a minimum separation distance between the third region A3 of the metal portion 10 and the coil conductor of the coil antenna 21.

The shape of the coil conductor of the coil antenna 21 and the shape of the cutout portion that is provided in the metal portion 10 of the casing are not limited to rectangular or substantially rectangular shapes. As in the present preferred embodiment, they may also be circular or substantially circular. Alternatively, they may be elliptical, oblong, or polygonal. Still alternatively, the shapes may partially include a linear portion and a curved portion.

Third Preferred Embodiment

In a third preferred embodiment of the present invention, examples of several preferred shapes of the recessed portion that is provided in the metal portion of the casing are described with reference to FIGS. 6A and 6B, FIGS. 7A and 7B, FIGS. 8A and 8B, FIGS. 9A and 9B, FIGS. 10A and 10B, FIGS. 11A and 11B, and FIGS. 12A and 12B. These figures are partial plan views of different antenna devices. FIGS. 6A, 7A, 8A, 9A, 10A, 11A, and 12A are plan views of the metal portion 10 of the casing including a portion that is overlapped by a coil conductor of a coil antenna 21, and a vicinity thereof. FIGS. 6B, 7B, 8B, 9B, 10B, 11B, and 12B are plan views of a state in which this portion is overlapped by a coil antenna sheet 20.

In each of these examples, the recessed portion 10CP is preferably provided along an extending portion 10DP. However, in the examples shown in FIGS. 6A and 6B, FIGS. 7A and 7B, FIGS. 8A and 8B, FIGS. 9A and 9B, and FIGS. 10A and 10B, the recessed portion 10CP is preferably partially provided along a winding direction, instead of in a region extending over an entire or substantially an entire periphery of the coil conductor of the coil antenna 21 in the winding direction. In this manner, the region in which the recessed portion 10CP is provided need not extend in the region over the entire or substantially the entire periphery of the coil conductor in the winding direction. However, when the length of the extension of the region in which the recessed portion 10CP is provided is larger, the effect of reducing or preventing an eddy current produced in the metal portion 10 is higher.

In each of the examples shown in FIGS. 11A and 11B and FIGS. 12A and 12B, a plurality of recessed portions 10CP are preferably provided in the metal portion 10 of the casing. These recessed portions 10CP are concentrically provided with respect to the center of a coil opening, and are provided in a region over the entire or substantially the entire periphery of the coil conductor of the coil antenna 21 in a winding direction. In this manner, a plurality of recessed portions may be provided in a radial direction with respect to the center of the coil opening.

The plurality of recessed portions may be arranged in both of the radial direction and a peripheral direction.

Fourth Preferred Embodiment

In a fourth preferred embodiment of the present invention, an example of an antenna device that includes a magnetic body is described.

Figure 13:
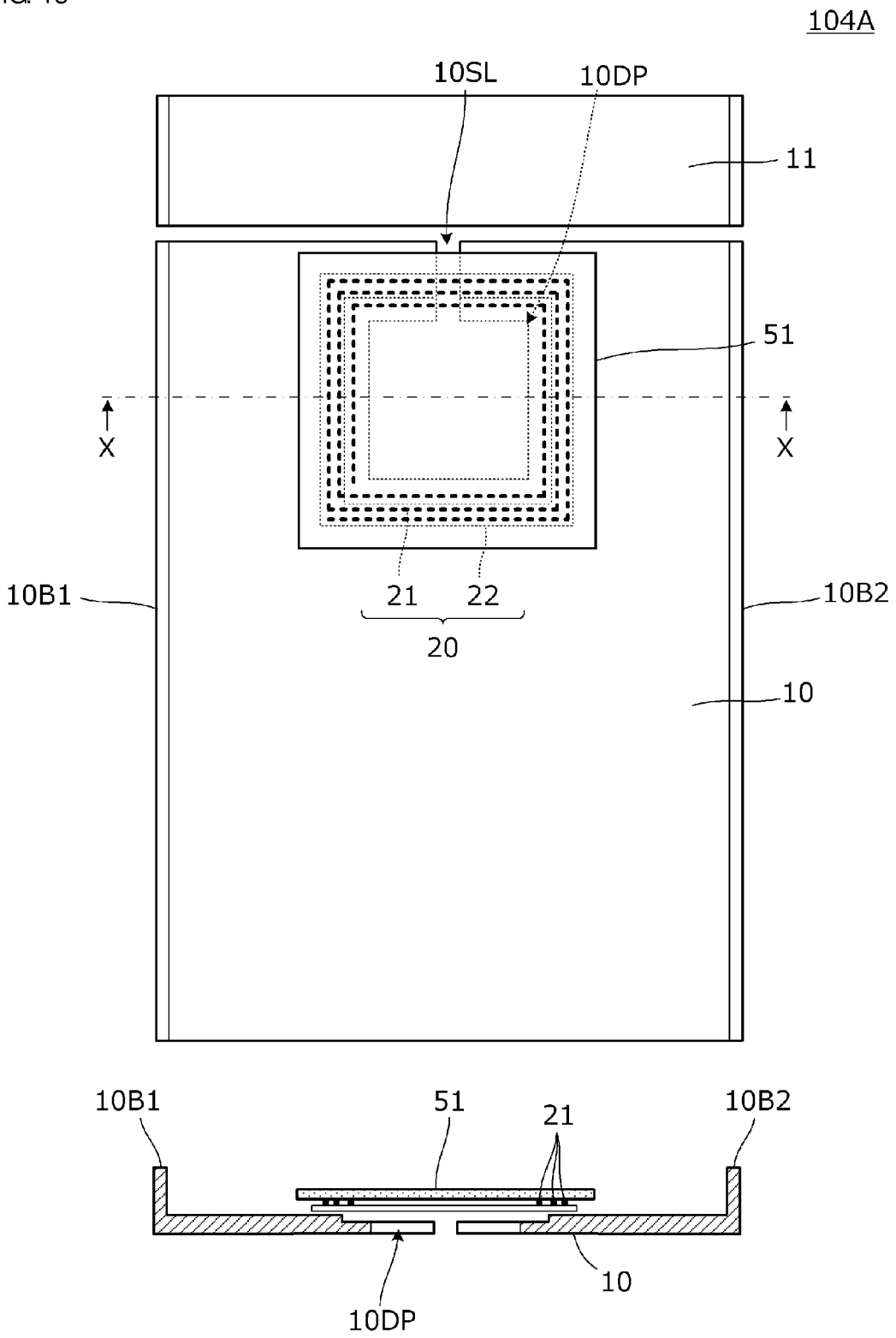
FIG. 13 shows a plan view of an antenna device 104A according to a fourth preferred embodiment of the present invention, and a sectional view of a portion thereof taken along X-X.

FIG. 13 shows a plan view of an antenna device 104A according to the fourth preferred embodiment, and a sectional view of a portion thereof taken along X-X. The antenna device 104A is one in which the antenna device 101 according to the first preferred embodiment includes a magnetic body 51.

Figure 14:
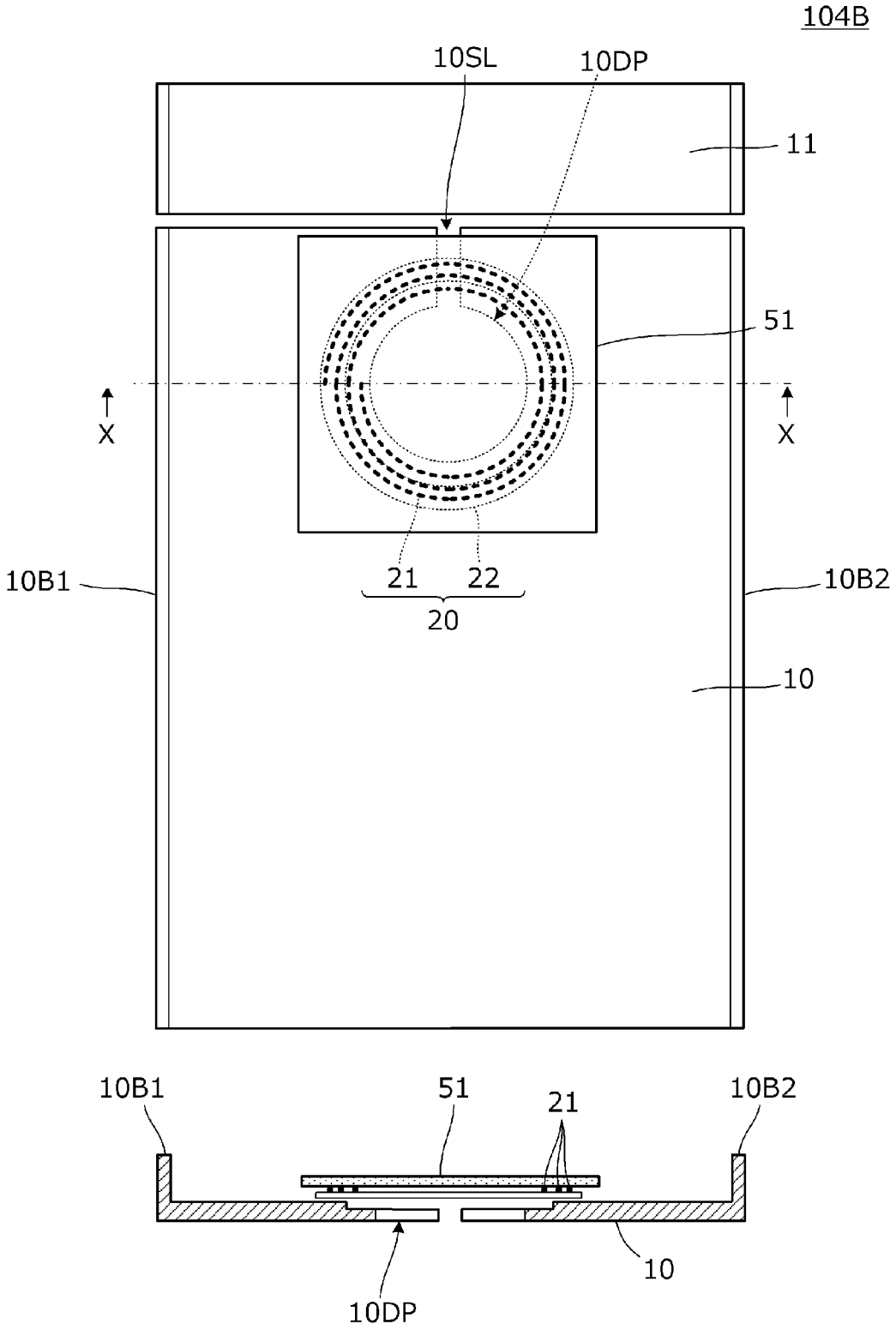
FIG. 14 shows a plan view of a different antenna device 104B according to the fourth preferred embodiment of the present invention, and a sectional view of a portion thereof taken along X-X.

FIG. 14 shows a plan view of a different antenna device 104B according to the fourth preferred embodiment, and a sectional view of a portion thereof taken along X-X. The antenna device 104B is one in which the antenna device 102 according to the second preferred embodiment includes a magnetic body 51. The magnetic body 51 is disposed on a side opposite to the metal portion 10 of the casing and along the area in which the coil conductor is provided.

In each of the antenna devices 104A and 104B, the magnetic body 51 is preferably a square or substantially square magnetic-body ferrite sheet, for example. The remaining structure is the same or substantially the same as that of the antenna device 101.

According to the present preferred embodiment, magnetic flux that crosses the coil antenna 21 passes through the magnetic body 51 having a high magnetic permeability. That is, the magnetic body acts as a magnetic path having a high magnetic permeability, and the effects of radiation and magnetic collection of magnetic flux at each of the antenna devices 104A and 104B are increased. In addition, it is possible to reduce or prevent unwanted coupling with a circuit board.

Fifth Preferred Embodiment

In a fifth preferred embodiment of the present invention, an example of an antenna device that differs from the antenna devices according to the fourth preferred embodiment in the size and shape of a magnetic body is described.

Figure 15:
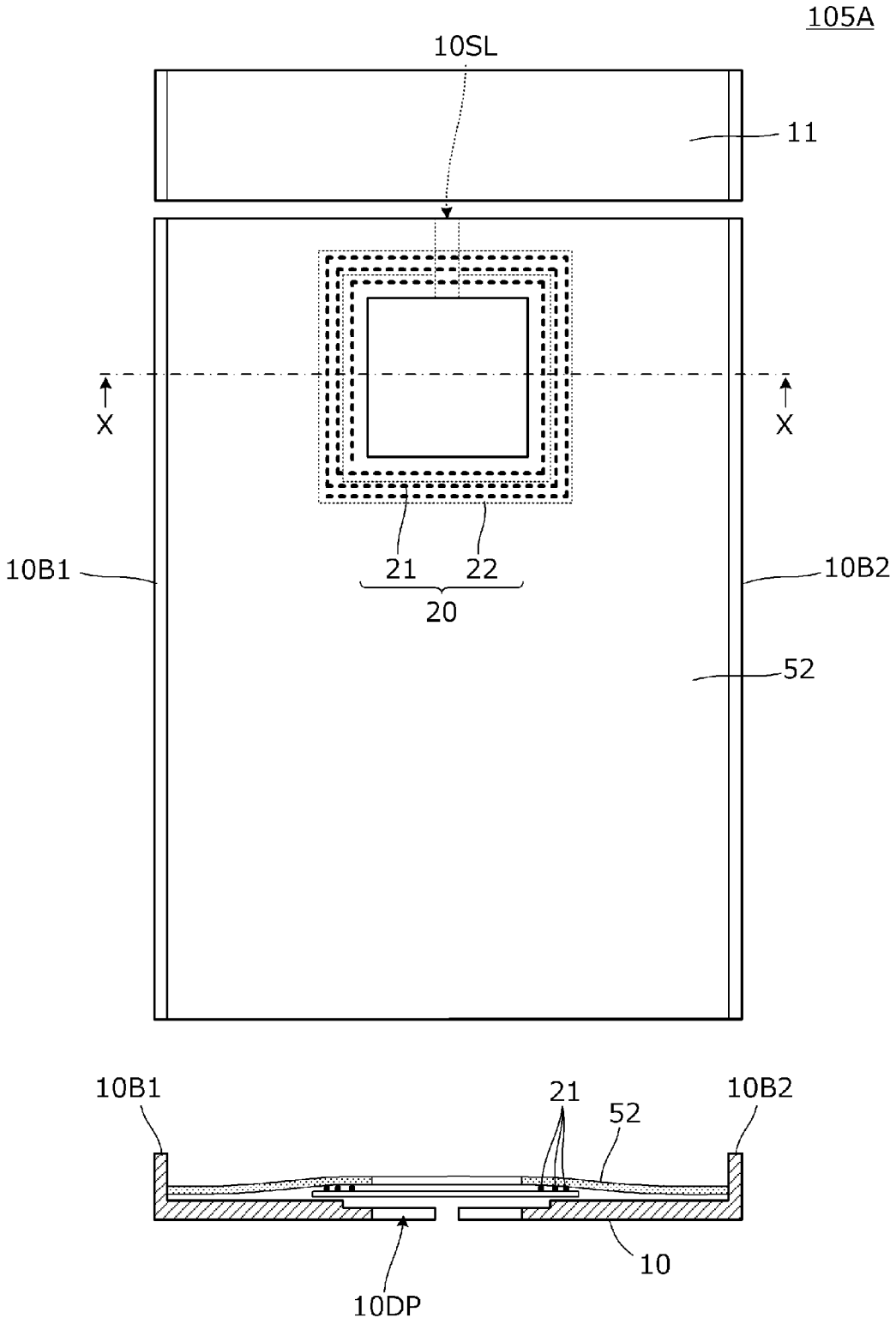
FIG. 15 shows a plan view of an antenna device 105A according to a fifth preferred embodiment of the present invention, and a sectional view of a portion thereof taken along X-X.

FIG. 15 shows a plan view of an antenna device 105A according to the fifth preferred embodiment, and a sectional view of a portion thereof taken along X-X. The antenna device 105A is one in which the antenna device 101 in the first preferred embodiment includes a magnetic body 52.

Figure 16:
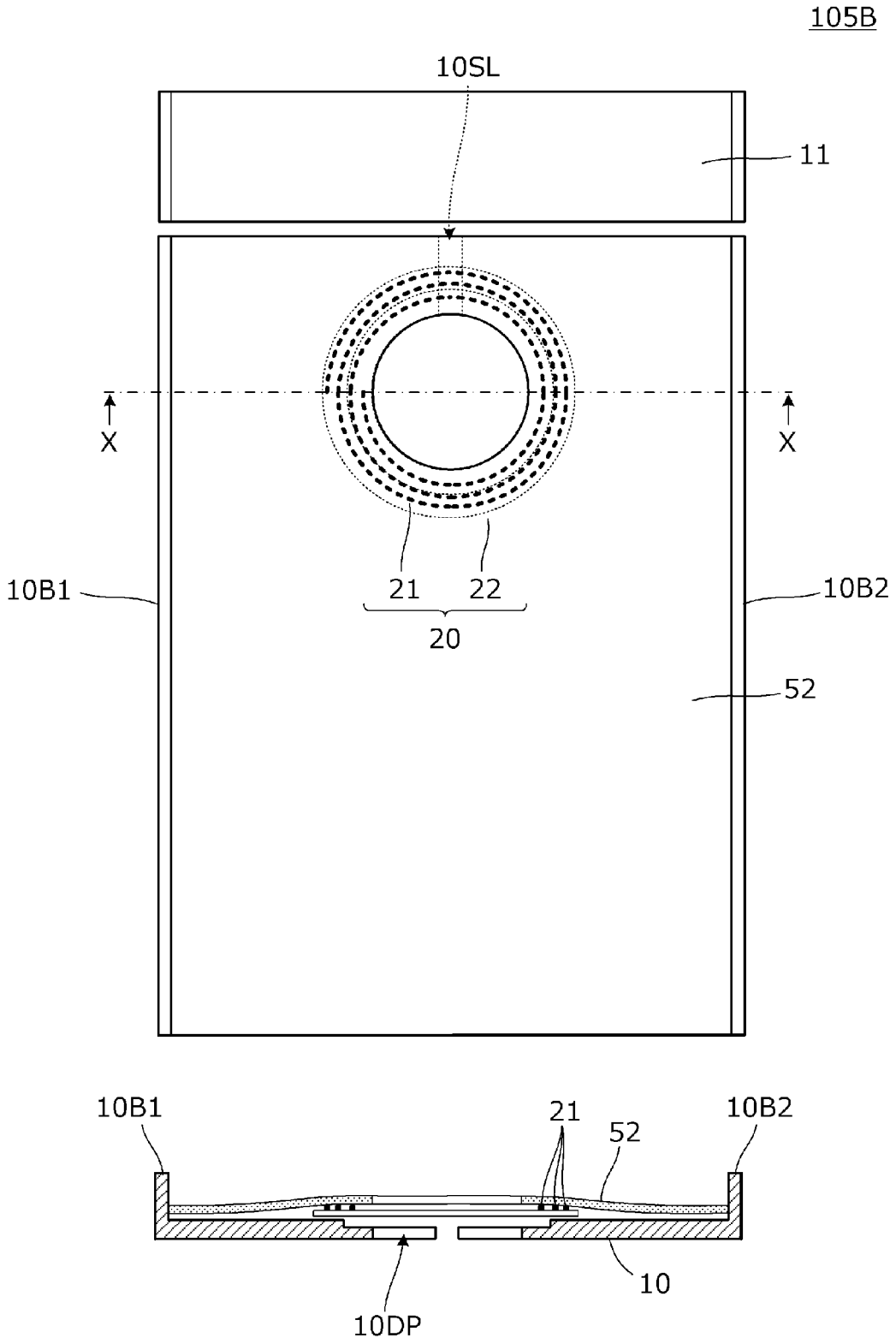
FIG. 16 shows a plan view of a different antenna device 105B according to the fifth preferred embodiment of the present invention, and a sectional view of a portion thereof taken along X-X.

FIG. 16 shows a plan view of a different antenna device 105B according to the fifth preferred embodiment, and a sectional view of a portion thereof taken along X-X. The antenna device 105B is one in which the antenna device 102 in the second preferred embodiment includes a magnetic body 52.

In each of the antenna devices 105A and 105B, the magnetic body 52 is a magnetic-body ferrite sheet having an opening in a portion thereof. The opening of each magnetic body 52 preferably has the same or substantially the same size as an extending portion 10DP of its corresponding metal portion 10, and overlaps the extending portion 10DP in plan view. A functional component, such as a camera module or a switch module, may be disposed so as to extend through the opening in the center of the magnetic body 52 and the extending portion 10DP of a metal portion 10. The magnetic body 52 is preferably a magnetic-body ferrite sheet having the same substantially the same size as a bottom surface of the metal portion 10. Therefore, two sides of the magnetic body 52 extend to the vicinity of bent portions 10B1 and 10B2 of the metal portion 10. The remaining structure is the same or substantially the same as that of the antenna devices 101 and 102.

According to the present preferred embodiment, magnetic flux that crosses the coil antenna 21 passes through the magnetic body 52 having a high magnetic permeability. That is, the magnetic body acts as a magnetic path having a high magnetic permeability. In particular, since the magnetic body 52 exists in the entire or substantially the entire region of the bottom surface of the metal portion 10, and the opening of the magnetic body 52 is provided where it overlaps the coil opening, the effects of radiation and magnetic collection of magnetic flux at each of the antenna devices 105A and 105B are increased. In addition, it is possible to reduce or prevent unwanted coupling of the magnetic body 52 with a circuit board.

Sixth Preferred Embodiment

In a sixth preferred embodiment of the present invention, an example in which the structure of a coil antenna differs from that of the first preferred embodiment is described.

Figure 17:
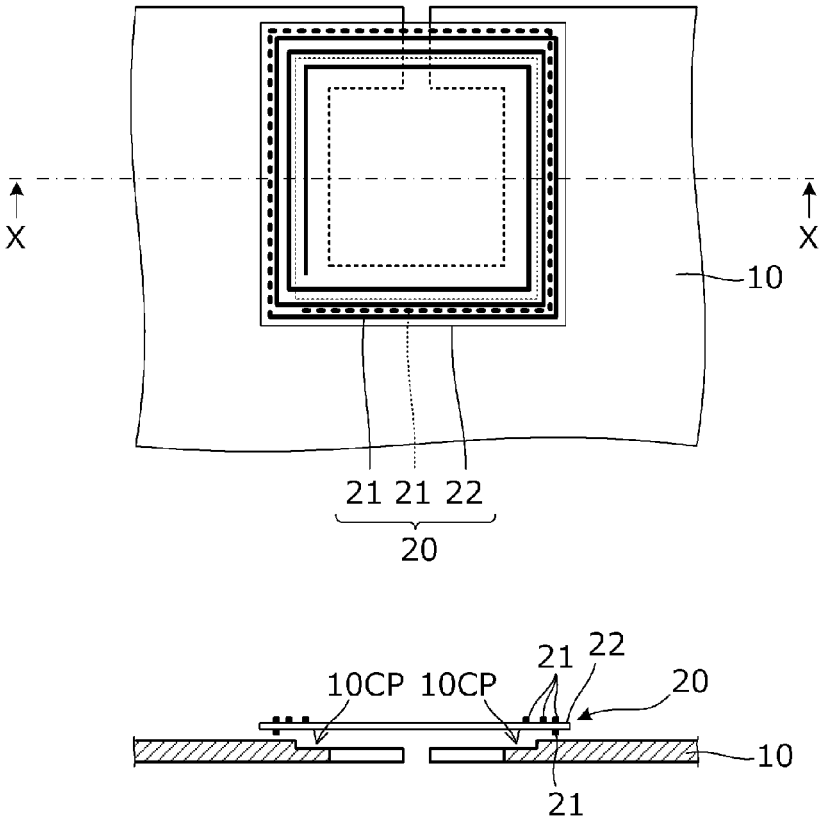
FIG. 17 shows a plan view of a structure of a coil antenna 21 of an antenna device according to a sixth preferred embodiment of the present invention, and a sectional view of a portion thereof taken along X-X.

FIG. 17 shows a plan view of a structure of a coil antenna 21 of an antenna device according to the sixth preferred embodiment, and a sectional view of a portion thereof taken along X-X.

In each of the preferred embodiments described above, examples in which the coil antenna 21 defined by a single-layer coil conductor is provided on a single surface of the insulating base 22 are described. The antenna device of the present preferred embodiment includes a coil antenna defined by a multilayer coil conductor.

In FIG. 17, the coil antenna 21 is provided on both surfaces of an insulating base 22. In this example, the winding direction of a coil conductor of the coil antenna 21 is bent back at an outer edge portion to define a two-layer structure, so that the number of windings is increased. As shown in FIG. 17, it is preferable that, of the multilayer coil conductor, a portion of the coil conductor in a layer having a small number of windings be disposed close to a side of a metal portion 10 of a casing. This further reduces or prevents an eddy current that flows in the metal portion 10. When the coil antenna is defined by the two-layer coil conductor, it is preferable that the number of windings in each layer differ for each layer. Therefore, parasitic capacitance at the coil antenna is reduced or prevented, so that it is possible to increase inductance while reducing or preventing deterioration in the characteristics of the antenna device. Further, as shown in FIG. 17, it is preferable that, of the multilayer coil conductor, the portion of the coil conductor in the layer having a small number of windings be on an outer peripheral side rather than on an inner periphery. With this structure, the portion of the coil conductor on the outer peripheral side having a low magnetic flux density is disposed close to the side of the metal portion 10 of the casing. Therefore, an eddy current that flows in the metal portion 10 is further reduced or prevented.

Seventh Preferred Embodiment

In a seventh preferred embodiment of the present invention, an example in which the shape of a metal portion defining a planar conductor differs from that in the preferred embodiments described thus far is described.

Figure 18:
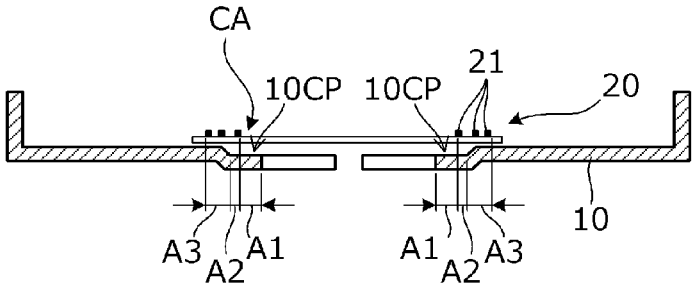
FIG. 18 is a sectional view of a main portion of an antenna device according to a seventh preferred embodiment of the present invention.

FIG. 18 is a sectional view of a main portion of an antenna device according to the seventh preferred embodiment. The structure of a coil antenna 21 is the same or substantially the same as that in the first preferred embodiment. A metal portion 10 of a casing of an electronic apparatus includes a first region A1 that overlaps a coil opening CA, a second region A2 that contacts the first region A1 and that does not extend to an outer edge of an area in which the coil antenna 21 is provided, and a third region A3 that extends from the second region A2 to the outer edge in plan view of the coil opening CA. Compared to the third region A3, the first region A1 and the second region A2 define a recessed portion 10CP that is recessed in a direction away from the coil antenna 21.

In the example shown in FIG. 2B and described in the first preferred embodiment, by causing the thickness of the metal portion 10 of the casing to partially differ, the first region A1, the second region A2, and the third region A3 are provided. However, in the present preferred embodiment, by partially providing a stepped portion with the thickness of the metal portion of the casing being maintained constant or substantially constant, the first region A1, the second region A2, and the third region A3 are provided.

Eighth Preferred Embodiment

In an eighth preferred embodiment of the present, an example in which the shape of a metal portion defining a planar conductor differs from that in the preferred embodiments described thus far is described.

Figure 19A:
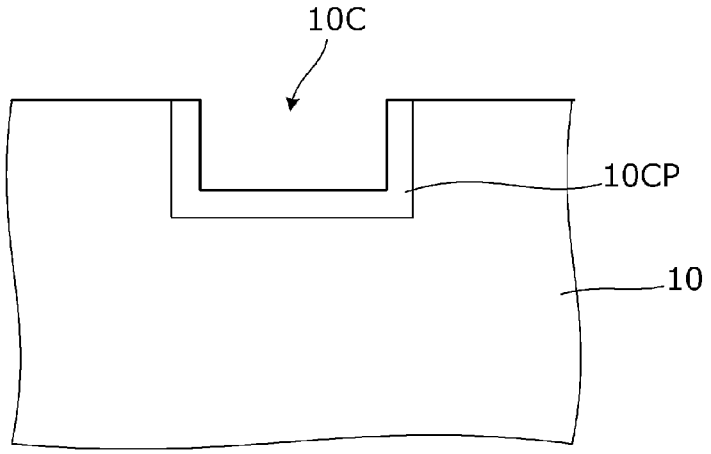
FIG. 19A is a plan view of a metal portion 10 of a casing of an antenna device according to an eighth preferred embodiment of the present invention including a portion that is overlapped by a coil conductor of a coil antenna 21, and a vicinity thereof.
Figure 19B:
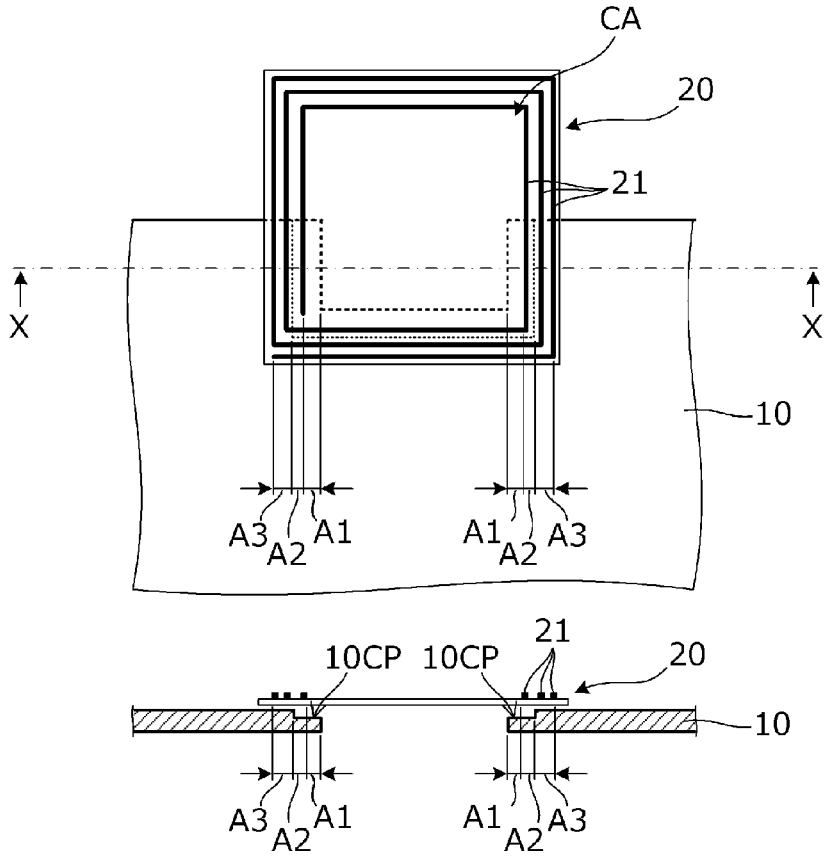
FIG. 19B shows a plan view of a vicinity of a coil antenna sheet 20 with the portion being overlapped by the coil antenna sheet 20, and a sectional view of a portion thereof taken along X-X.

FIG. 19A is a plan view of a metal portion 10 of a casing including a portion that is overlapped by a coil conductor of a coil antenna 21, and a vicinity thereof. FIG. 19B shows a plan view of a state in which this portion is overlapped by a coil antenna sheet 20, and a sectional view of a portion thereof taken along X-X.

A cutout portion 10C having a constant or substantially constant width is provided in a metal portion 10 of a casing of an antenna device shown in FIGS. 19A and 19B. The coil antenna 21 is disposed along the cutout portion 10C. With this structure, a first region A1, a second region A2, and a third region A3 are provided.

Preferred embodiments of the present invention are also similarly applicable to such an antenna device including a planar conductor including a cutout portion with a constant or substantially constant width.

Ninth Preferred Embodiment

In a ninth preferred embodiment of the present invention, an example in which the shape of a metal portion defining a planar conductor differs from that in the preferred embodiments described thus far is described.

Figure 20A:
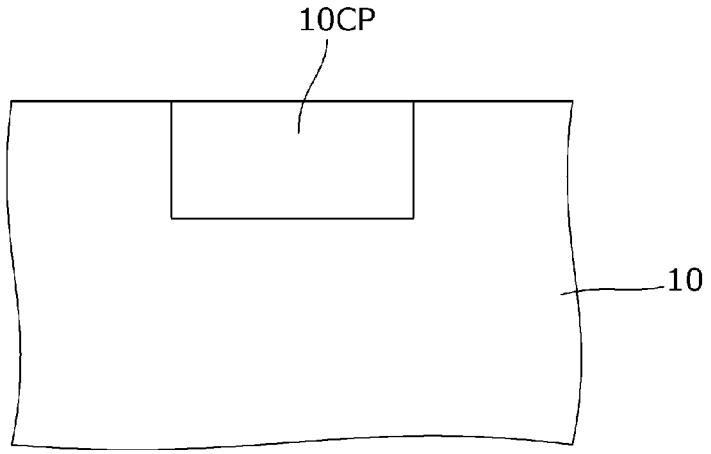
FIG. 20A is a plan view of a metal portion 10 of a casing of an antenna device according to a ninth preferred embodiment of the present invention including a portion that is overlapped by a coil conductor of a coil antenna 21, and a vicinity thereof.
Figure 20B:
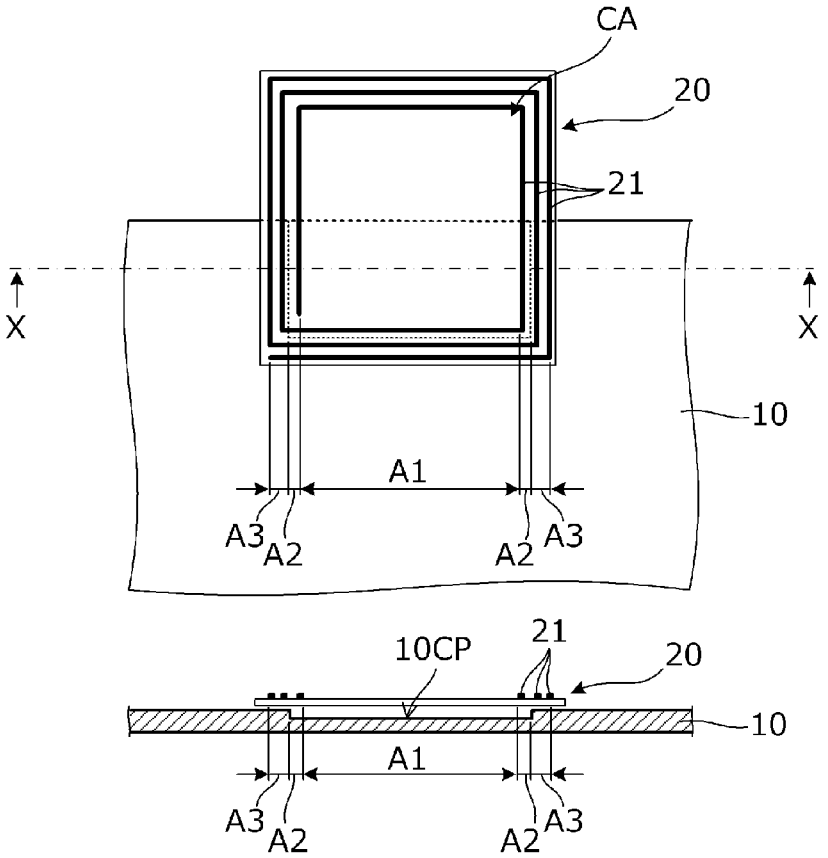
FIG. 20B shows a plan view of a vicinity of a coil antenna sheet 20 with the portion being overlapped by the coil antenna sheet 20, and a sectional view of a portion thereof taken along X-X.

FIG. 20A is a plan view of a metal portion 10 of a casing of an antenna device according to the ninth preferred embodiment including a portion that is overlapped by a coil conductor of a coil antenna 21, and a vicinity thereof. FIG. 20B shows a plan view of a state in which this portion is overlapped by a coil antenna sheet 20, and a sectional view of a portion thereof taken along X-X.

A cutout portion is not provided in the metal portion 10 of the casing of the antenna device of the preferred embodiment. The coil antenna 21 is disposed such that a portion thereof overlaps an outer edge of the metal portion 10 in plan view. A recessed portion 10CP is provided in the metal portion 10 at a location at which an inner peripheral portion of the coil antenna overlaps the recessed portion 10CP in the plan view. With this structure, a first region A1, a second region A2, and a third region A3 are provided.

Preferred embodiments of the present invention are also similarly applicable to such an antenna device including a planar conductor without a cutout portion.

Tenth Preferred Embodiment

In a tenth preferred embodiment of the present invention, an antenna device that does not include a special recessed portion at a location on a metal portion, defining a planar conductor, of a casing is described, the location facing a coil antenna.

Figure 21:
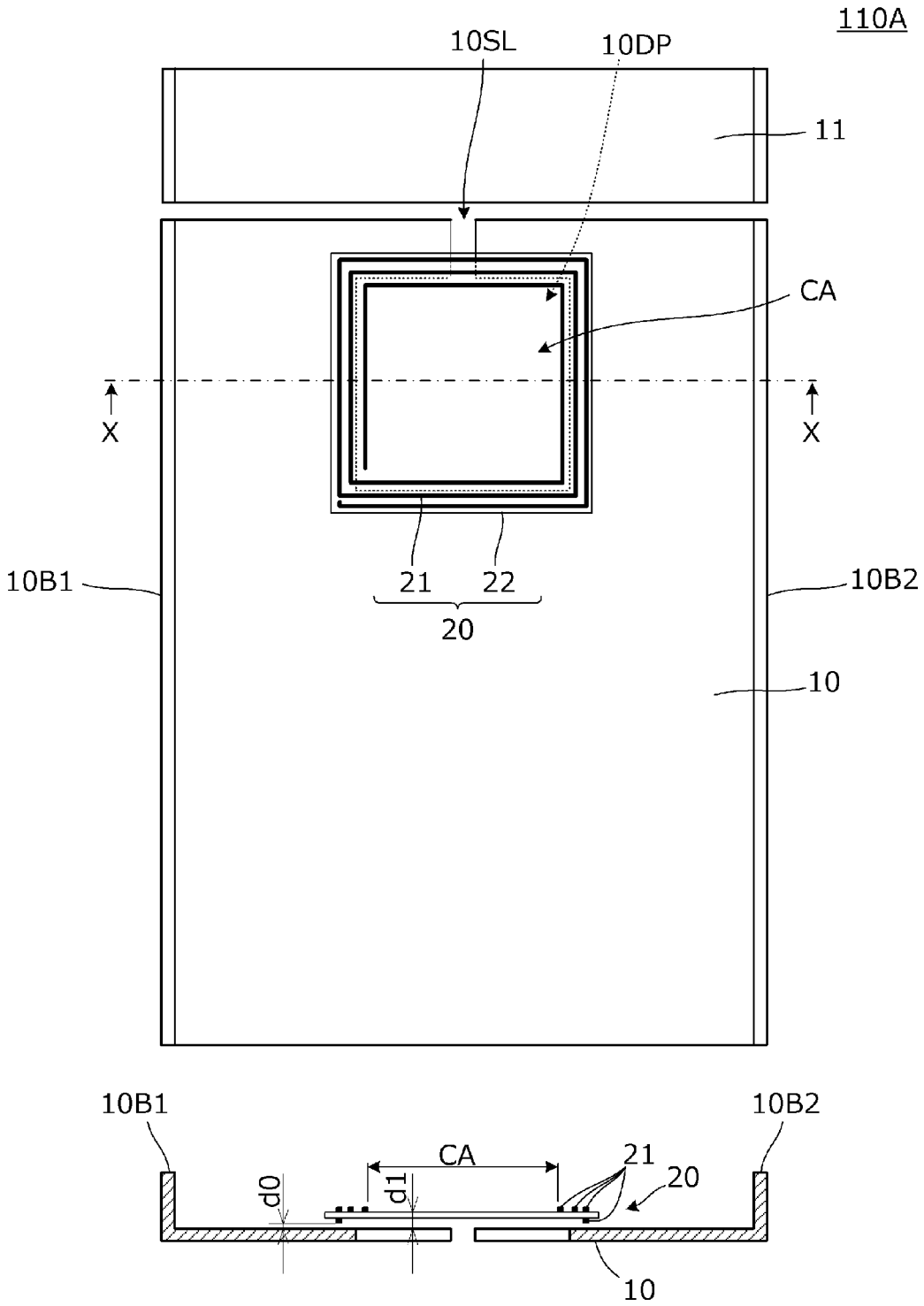
FIG. 21 shows a plan view of an antenna device 110A according to a tenth preferred embodiment of the present invention, and a sectional view of a portion thereof taken along X-X.

FIG. 21 shows a plan view of an antenna device 110A according to the tenth preferred embodiment, and a sectional view of a portion thereof taken along X-X. A coil antenna 21 of the antenna device 110A is preferably defined by a square or substantially square spiral coil conductor. In accordance with this structure, a cutout portion that is provided in a metal portion 10 of the casing includes a slit 10SL and a rectangular or substantially rectangular extending portion 10DP.

The coil antenna 21 defined by a square or substantially square spiral coil conductor is provided on a square insulating base 22. The coil antenna 21 is preferably defined by a multi-layer coil conductor that includes square spiral conductor patterns provided on both surfaces of the square insulating base 22 that are connected to each other via a via conductor (not shown) extending through the insulating base 22. The insulating base 22 and the coil antenna 21 define a coil antenna sheet 20.

Figure 22:
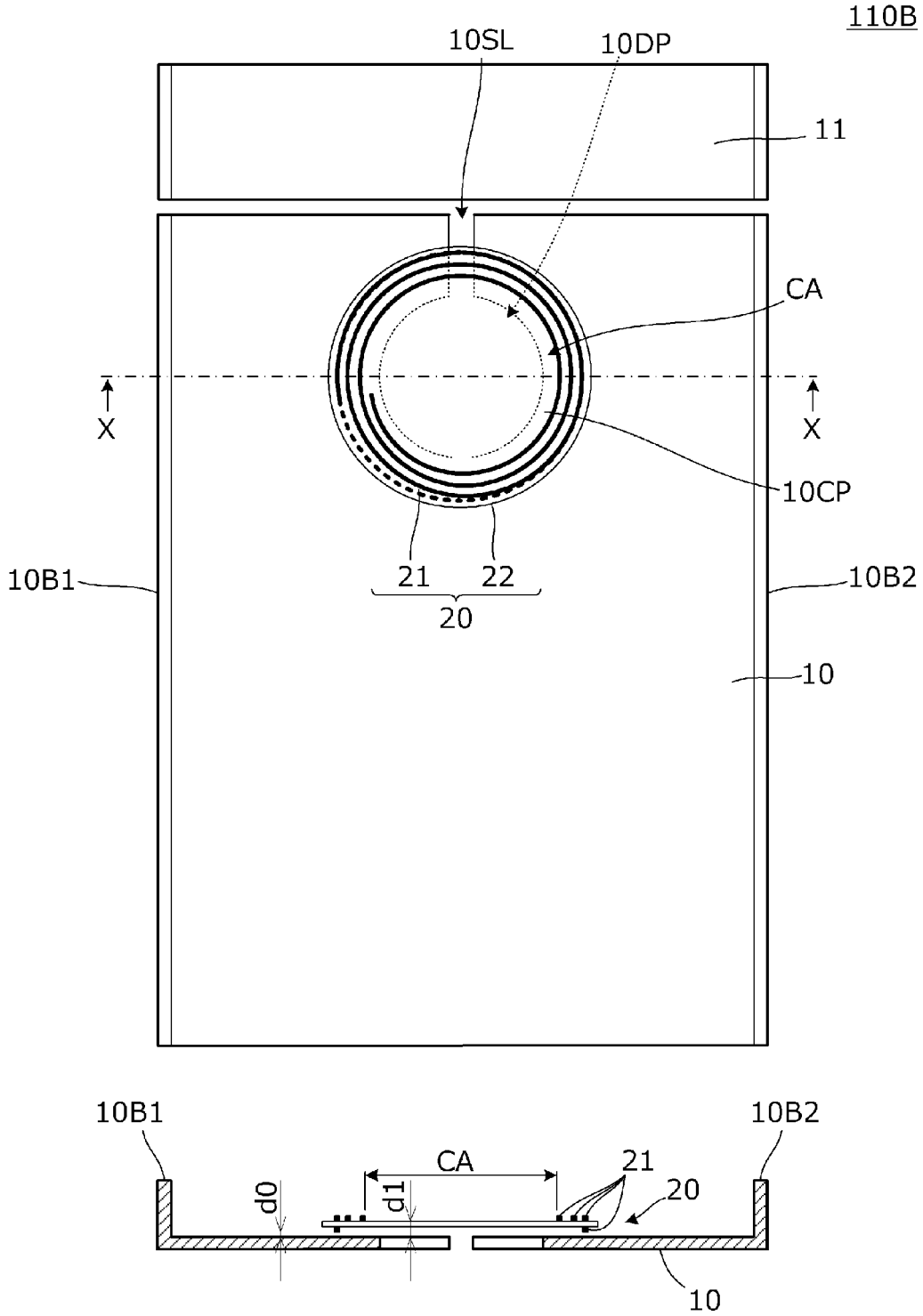
FIG. 22 shows a plan view of a different antenna device 110B according to the tenth preferred embodiment of the present invention, and a sectional view of a portion thereof taken along X-X.

FIG. 22 shows a plan view of a different antenna device 110B according to the tenth preferred embodiment, and a sectional view of a portion thereof taken along X-X. A coil antenna 21 of the antenna device 110B is preferably defined by a spiral coil conductor. In accordance with this structure, a cutout portion that is provided in a metal portion 10 of a casing preferably includes a slit 10SL and a circular or substantially circular extending portion 10DP.

The coil antenna 21 defined by a spiral coil conductor is provided on a circular insulating base 22. The coil antenna 21 includes a multi-layer coil conductor including circular or substantially circular spiral conductor patterns provided on both surfaces of the circular insulating base 22 that are connected to each other via a via conductor (not shown) extending through the insulating base 22. The insulating base 22 and the coil antenna 21 define a coil antenna sheet 20.

Even in the examples of the antenna devices 110A and 110B, the basic structure of the coil antenna sheet 20 is the same or substantially the same as in the preferred embodiments described thus far. In the present preferred embodiment, the coil antenna is provided on both surfaces of the insulating base 22. A recessed portion (10CP) such as that shown in FIG. 1 is not provided in the antenna devices 110A and 110B of the present preferred embodiment.

Even in the examples of the antenna devices 110A and 110B, a separation distance d1 between a region of a coil opening CA of the coil antenna 21 and the metal portion 10 of the casing is larger than a minimum separation distance d0 between the coil conductor and the metal portion 10 of the casing. The region of the coil opening CA here refers to a region that is surrounded by a portion of the coil conductor located on an innermost side in plan view in a winding axis direction of the coil antenna 21, and disposed at a height of the portion of the coil conductor on the innermost side in the winding axis direction. That is, the portion of the coil conductor on the innermost side contacts the region of the coil opening CA. Therefore, the separation distance d1 is the same or substantially the same as the distance between the portion of the coil conductor on the innermost side and the metal portion 10 of the casing in the winding axis direction of the coil antenna 21.

According to the present preferred embodiment, a space is provided between the coil conductor of the coil antenna 21 and the metal portion 10 of the casing, so that the amount of magnetic flux that crosses the metal portion 10 of the casing is reduced, and the Q value of the coil antenna 12 is improved.

Eleventh Preferred Embodiment

In an eleventh preferred embodiment of the present invention, an example of an antenna device is described that does not include a special recessed portion at a location on a metal portion, defining a planar conductor, of a casing, the location facing a coil antenna, and in which a relationship between a coil opening and a cutout portion differs from those of the preferred embodiments described thus far.

Figure 23:
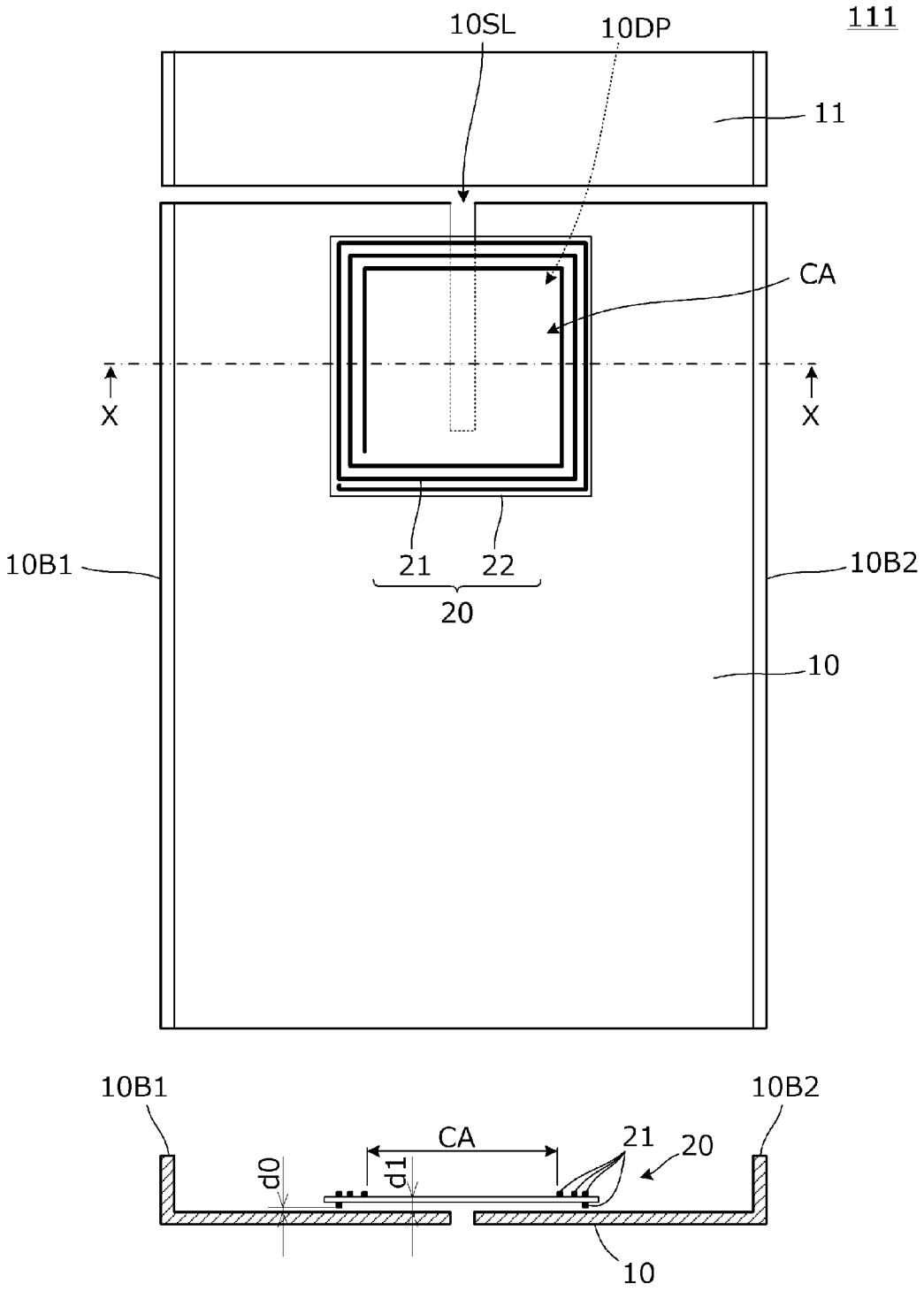
FIG. 23 shows a plan view of an antenna device 111 according to an eleventh preferred embodiment of the present invention and a sectional view of a portion thereof taken along X-X.

FIG. 23 shows a plan view of an antenna device 111 according to the eleventh preferred embodiment and a sectional view of a portion thereof taken along X-X. A coil antenna 21 of the antenna device 111 is defined by a square or substantially square spiral coil conductor. A cutout portion that is provided in a metal portion 10 of the casing is defined by a slit 10SL.

The coil antenna 21 defined by a square or substantially square spiral coil conductor is provided on a square or substantially square insulating base 22. The insulating base 22 and the coil antenna 21 define a coil antenna sheet 20.

The coil antenna 21 is provided on both surfaces of the insulating base 22. In the antenna device 111 of the present preferred embodiment, a recessed portion (10CP) such as that shown in FIG. 1 is not provided.

In the present preferred embodiment, a separation distance d1 between a region of a coil opening CA of the coil conductor of the coil antenna 21 and the metal portion 10 of the casing is larger than a minimum separation distance d0 between the coil conductor and the metal portion 10 of the casing.

According to the present preferred embodiment, a space is provided between the coil conductor of the coil antenna 21 and the metal portion 10 of the casing, so that the amount of magnetic flux that crosses the metal portion 10 of the casing is reduced, and the Q value of the coil antenna 12 is improved.

Twelfth Preferred Embodiment

In a twelfth preferred embodiment of the present invention, an example of an antenna device is described that does not include a special recessed portion at a location on a metal portion, defining a planar conductor, of a casing, the location facing a coil antenna, and that includes a cutout portion having a shape that is different from those of the preferred embodiments described thus far.

Figure 24:
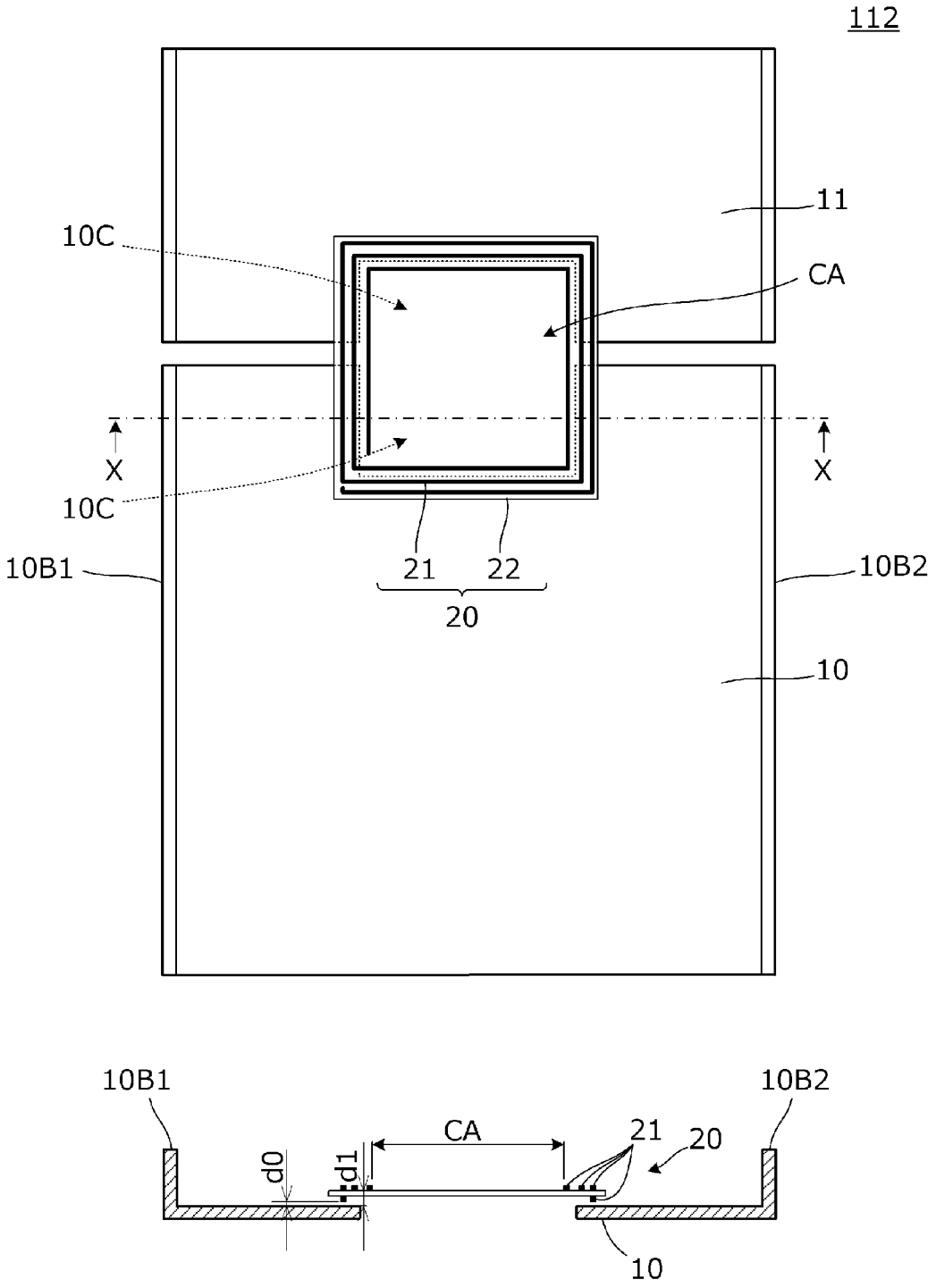
FIG. 24 shows a plan view of an antenna device 112 according to a twelfth preferred embodiment of the present invention and a sectional view of a portion thereof taken along X-X.

FIG. 24 shows a plan view of an antenna device 112 according to the twelfth preferred embodiment and a sectional view of a portion thereof taken along X-X. Metal portions 10 and 11 of a casing are provided side by side in the same plane. The metal portions 10 and 11 each include a rectangular or substantially rectangular cutout portion 10C. These cutout portions 10C are arranged side by side. The structure of a coil antenna sheet 20 is the same or substantially the same as that of the tenth preferred embodiment.

In the present preferred embodiment, a separation distance d1 between a region of a coil opening CA of a coil conductor of the coil antenna 21 and the metal portion 10 of the casing is preferably larger than a minimum separation distance d0 between the coil conductor and the metal portion 10 of the casing.

In this manner, preferred embodiments of the present invention are also similarly applicable to an antenna device in which the cutout portions 10C are provided in the two metal portions 10 and 11 (planar conductors) that are arranged side by side.

Thirteenth Preferred Embodiment

In a thirteenth preferred embodiment of the present invention, an example of an antenna device that includes metal portions, defining planar conductors, of a casing that do not include a cutout portion and a recessed portion is described.

Figure 25:
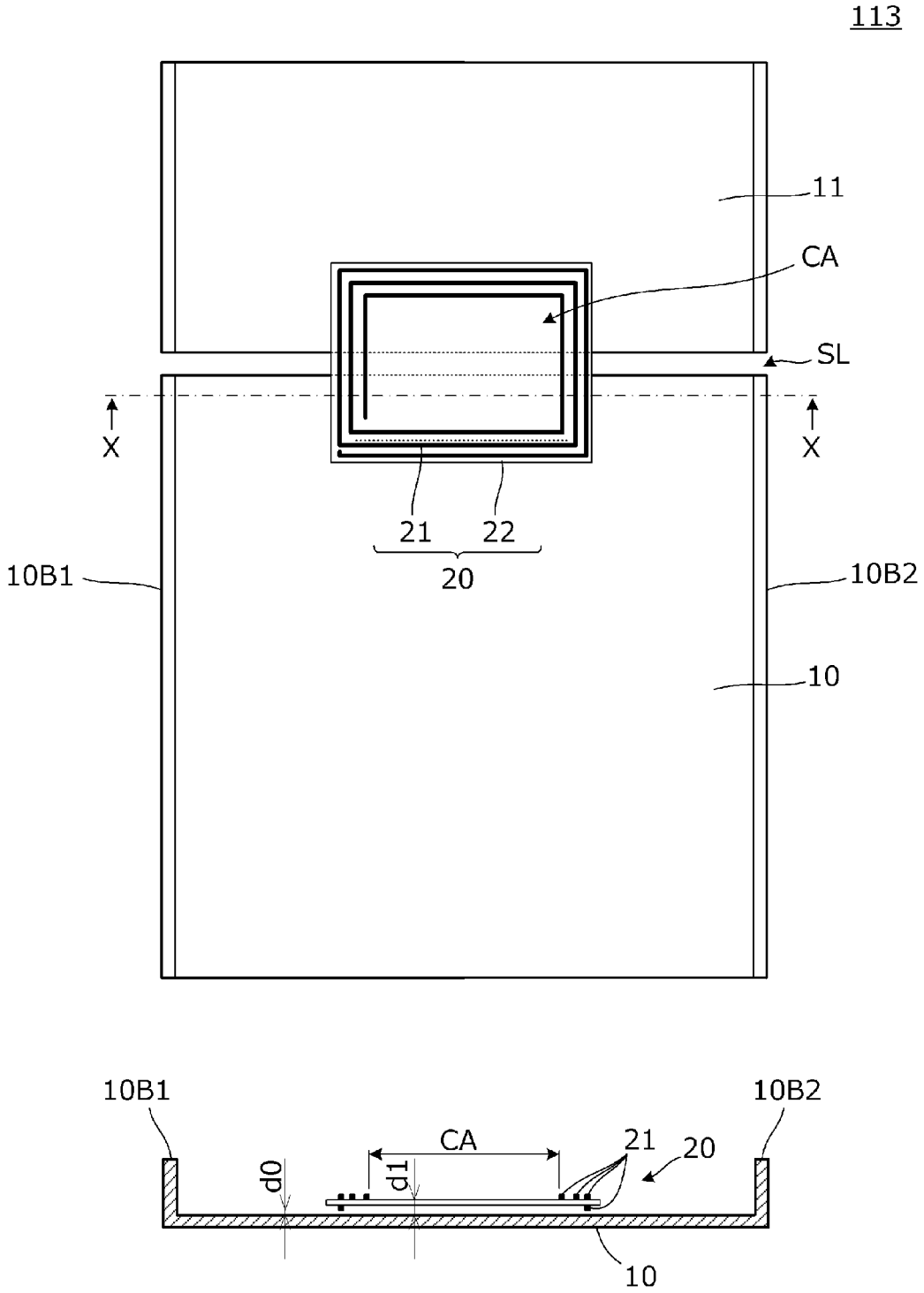
FIG. 25 shows a plan view of an antenna device 113 according to a thirteenth preferred embodiment of the present invention and a sectional view of a portion thereof taken along X-X.

FIG. 25 shows a plan view of an antenna device 113 according to the thirteenth preferred embodiment and a sectional view of a portion thereof taken along X-X. Metal portions 10 and 11 of the casing are provided side by side in the same plane, and a slit SL is provided therebetween. The metal portions 10 and 11 do not include a cutout portion and a recessed portion. The basic structure of a coil antenna sheet 20 is the same or substantially the same as that of the tenth preferred embodiment.

In the present preferred embodiment, a separation distance d1 between a region of a coil opening CA of a coil conductor of a coil antenna 21 and the metal portion 10 of the casing is preferably larger than a minimum separation distance d0 between the coil conductor and the metal portion 10 of the casing.

In this manner, preferred embodiments of the present invention are also similarly applicable to an antenna device that does not include a cutout portion and a recessed portion in each of the two metal portions 10 and 11 (planar conductors) that are arranged side by side.

Fourteenth Preferred Embodiment

In a fourteenth preferred embodiment of the present invention, several types of antenna devices in which facing relationships between a coil conductor of a coil antenna 21 and a metal portion (planar conductor) 10 of a casing differ from each other are described.

Figure 26:
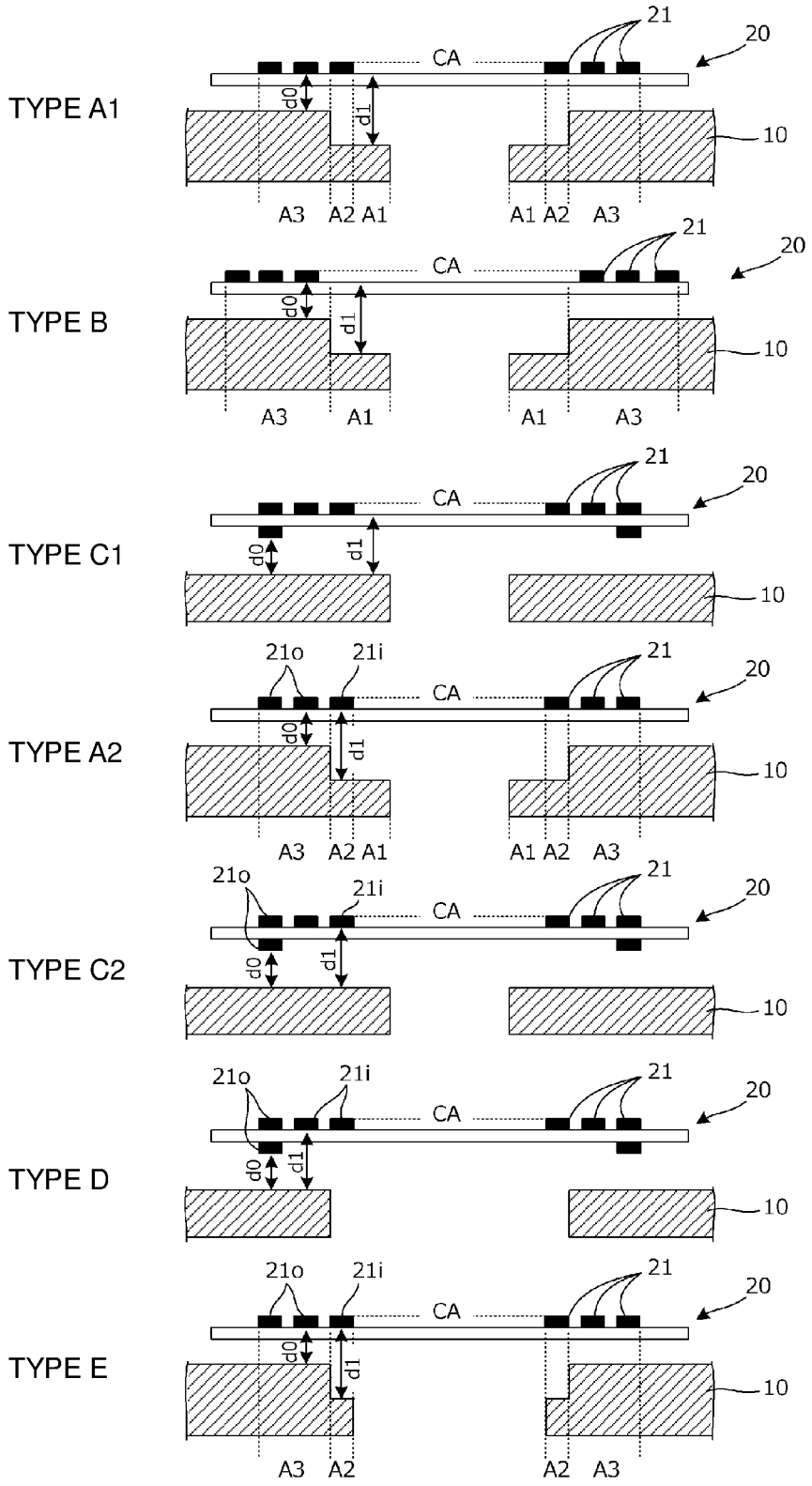
FIG. 26 is a sectional view of several types of antenna devices according to a fourteenth preferred embodiment of the present invention.

FIG. 26 shows sectional views of the several types of antenna devices.

Type A1 in FIG. 26 corresponds to the antenna devices having the structures shown in FIGS. 1 to 5 and FIGS. 13 to 20. A planar conductor 10 includes a first region A1 that overlaps at least a portion of a coil opening CA and a third region A3 that overlaps an outer edge of the coil conductor in plan view of the coil opening CA. Compared to the third region A3, the first region A1 is provided with a recessed portion that is recessed in a direction away from the coil conductor.

The antenna device of type B corresponds to, for example, a type in which the antenna device shown in FIGS. 19A and 19B does not include the region A2. That is, "a second region that overlaps the inner edge of the coil conductor in plan view of the coil opening CA" does not exist, and the entire coil conductor overlaps the third region A3. In this manner, even if the antenna device only includes the first region A1 and the third region A3, the first region A1 having a high magnetic flux density reduces an eddy current that flows in the metal portion 10, so that the Q value of the coil antenna is improved.

Type C1 corresponds to the antenna devices having the structures shown in FIGS. 22, 23, and 25. The planar conductor 10 does not include a special recessed portion at a location facing a coil antenna 21. The coil antenna 21 is defined by a multilayer coil conductor that includes spiral conductor patterns provided on both surfaces of an insulating base 22 that are connected to each other via a via conductor (not shown) extending through the insulating base 22.

The types A1, B, and C1 include the coil antenna 21 that is wound around the coil opening CA and the metal portion (planar conductor) 10 of the casing that includes a surface facing a portion of the coil opening and a portion of the area in which the coil conductor is provided. The minimum separation distance d1 between the coil opening CA and the planar conductor in the direction perpendicular or substantially perpendicular to the planar conductor is larger than the minimum separation distance d0 between the coil conductor and the planar conductor in the direction perpendicular or substantially perpendicular to the planar conductor.

The antenna device of type A2 structurally corresponds to the antenna devices having the structures shown in FIGS. 1 to 5 and FIGS. 13 to 20, and differs from the type A1 in the definition of the separation distance d1.

The antenna device of type C2 structurally corresponds to the antenna devices having the structures shown in FIGS. 22, 23, and 25, and differs from the type C1 in the definition of the separation distance d1.

The antenna device of type D corresponds to the antenna devices having the structures shown in FIGS. 21 and 24. The planar conductor does not include a special recessed portion at a location facing a coil antenna 21. The coil antenna 21 is defined by a multi-layer coil conductor including spiral conductor patterns provided on both surfaces of the insulating base 22 that are connected to each other via a via conductor (not shown) extending through the insulating base 22. The type D differs from the type C2 in that it does not include a region in which the planar conductor 10 overlaps a coil opening CA in plan view of the coil opening CA.

The antenna device of type E corresponds to, for example, a type in which the antenna device shown in FIGS. 2A and 2B does not include the region A1. That is, "a first region that overlaps at least a portion of the coil opening in plan view of the coil opening" does not exist, and a coil opening side of the second region A2 is disposed at the coil opening. In this manner, even if the antenna device only includes the second region A2 and the third region A3, the second region A2 having a high magnetic flux density reduces an eddy current that flows in the metal portion 10, so that the Q value of the coil antenna is improved.

In the antenna devices of the types A2, C2, D, and E, the coil antenna is defined by a coil conductor including a first coil conductor portion 21*i* located on an inner peripheral side and wound around the coil opening and a second coil conductor 21*o* located on an outer peripheral side. A minimum separation distance d1 between the first coil conductor portion 21*i* and the metal portion (planar conductor) of the casing in the direction perpendicular or substantially perpendicular to the planar conductor is preferably larger than a minimum separation distance d0 between the second coil conductor portion 210 and the planar conductor in the normal direction to the planar conductor.

Although, in FIG. 26, only the sectional views of the antenna devices of the corresponding types are shown, the planar shape of each portion is applicable to those that are shown in each figure other than FIG. 26.

Although, in the several preferred embodiments described above, an example in which the metal portion 11 is disposed side by side with the metal portion 10 including the cutout portion is described, it is not necessary to include the metal portion 11 that does not include a cutout portion. Preferred embodiments of the present invention are also similarly applicable to a structure that does not include the metal portion 11.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a coil antenna that includes a coil conductor wound around a coil opening; and a planar conductor that includes a surface facing a portion of the coil opening and a portion of an area in which the coil conductor is provided; wherein a minimum separation distance between the coil opening and the planar conductor in a direction perpendicular or substantially perpendicular to the planar conductor is larger than a minimum separation distance between the coil conductor and the planar conductor in the direction perpendicular or substantially perpendicular to the planar conductor; and the coil opening is defined by the coil conductor.

2. The antenna device according to claim 1, wherein the planar conductor includes a first region that overlaps at least a portion of the coil opening and a third region that overlaps an outer edge of the coil conductor in plan view of the coil opening; and the first region is provided with a recessed portion that is recessed in a direction away from the coil conductor compared to the third region.

3. The antenna device according to claim 2, wherein the first region is a region extending over an entire or substantially an entire periphery of the coil conductor in a winding direction.

4. The antenna device according to claim 2, wherein a plurality of the recessed portions of the planar conductor are provided.

5. The antenna device according to claim 1, wherein the coil antenna includes a magnetic body that is disposed on a side opposite to the planar conductor when seen in parallel or substantially in parallel with the planar conductor and along an area in which the coil conductor is provided when seen in plan view of the planar conductor.

6. The antenna device according to claim 1, wherein the planar conductor includes a cutout portion that extends inwardly from an outer edge; and the coil opening overlaps at least a portion of the cutout portion in plan view of the coil opening.

7. The antenna device according to claim 6, wherein the cutout portion includes an inner portion and an outer portion; and the inner portion is wider than the outer portion when seen in plan view of the planar conductor.

8. An antenna device comprising:

a coil antenna that includes a first coil conductor portion provided on an inner peripheral side and wound around a coil opening and a second coil conductor portion provided on an outer peripheral side; and a planar conductor that includes a surface facing the first coil conductor portion and the second coil conductor portion; wherein a minimum separation distance between the first coil conductor portion and the planar conductor in a direction perpendicular or substantially perpendicular to the planar conductor is larger than a minimum separation distance between the second coil conductor portion and the planar conductor in the direction perpendicular or substantially perpendicular to the planar conductor.

9. The antenna device according to claim 8, wherein the planar conductor includes a second region that overlaps an inner edge of the coil conductor, and a third region that overlaps an outer edge of the coil conductor in plan view of the coil opening; and the second region is provided with a recessed portion that is recessed in a direction away from the coil conductor compared to the third region.

10. The antenna device according to claim 9, wherein the second region is a region extending over an entire or substantially an entire periphery of the coil conductor in a winding direction.

11. The antenna device according to claim 9, wherein a plurality of the recessed portions of the planar conductor are provided.

12. The antenna device according to claim 8, wherein the coil antenna includes a magnetic body that is disposed on a side opposite to the planar conductor when seen in parallel or substantially in parallel with the planar conductor and along an area in which the coil conductor is provided when seen in plan view of the planar conductor.

13. The antenna device according to claim 8, wherein the planar conductor includes a cutout portion that extends inwardly from an outer edge; and the coil opening overlaps at least a portion of the cutout portion in plan view of the coil opening.

14. The antenna device according to claim 13, wherein the cutout portion includes an inner portion and an outer portion; and the inner portion is wider than the outer portion when seen in plan view of the planar conductor.

15. An electronic apparatus comprising:

an antenna device including:

a coil antenna that includes a coil conductor wound around a coil opening; and a planar conductor that includes a surface facing a portion of the coil opening and a portion of a region in which the coil conductor is provided; wherein a minimum separation distance between the coil opening and the planar conductor in a direction perpendicular or substantially perpendicular to the planar conductor is larger than a minimum separation distance between the coil conductor and the planar conductor in the direction perpendicular or substantially perpendicular to the planar conductor; and the coil opening is defined by the coil conductor.

16. The electronic apparatus according to claim 15, wherein the planar conductor includes a first region that overlaps at least a portion of the coil opening and a third region that overlaps an outer edge of the coil conductor in plan view of the coil opening; and the first region is provided with a recessed portion that is recessed in a direction away from the coil conductor compared to the third region.

17. The electronic apparatus according to claim 16, wherein the first region is a region extending over an entire or substantially an entire periphery of the coil conductor in a winding direction.

18. An electronic apparatus comprising:

an antenna device including:

a coil antenna that includes a first coil conductor portion provided on an inner peripheral side and wound around a coil opening and a second coil conductor portion provided on an outer peripheral side; and a planar conductor that includes a surface facing the first coil conductor portion and the second coil conductor portion; wherein a minimum separation distance between the first coil conductor portion and the planar conductor in a direction perpendicular or substantially perpendicular to the planar conductor is larger than a minimum separation distance between the second coil conductor portion and the planar conductor in the direction perpendicular or substantially perpendicular to the planar conductor.

19. The electronic apparatus according to claim 18, wherein the planar conductor includes a second region that overlaps an inner edge of the coil conductor, and a third region that overlaps an outer edge of the coil conductor in plan view of the coil opening; and the second region is provided with a recessed portion that is recessed in a direction away from the coil conductor compared to the third region.

20. The electronic apparatus according to claim 19, wherein the second region is a region extending over an entire or substantially an entire periphery of the coil conductor in a winding direction.

* * * * *